US011815826B2

(12) United States Patent
Hijikata et al.

(10) Patent No.: US 11,815,826 B2
(45) Date of Patent: Nov. 14, 2023

(54) DEVELOPING UNIT

(71) Applicant: CANON KABUSHIKI KAISHA, Tokyo (JP)

(72) Inventors: Shunsuke Hijikata, Kanagawa (JP); Sohta Sugimoto, Kanagawa (JP); Yasuyuki Egami, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/893,393

(22) Filed: Aug. 23, 2022

(65) Prior Publication Data

US 2023/0065299 A1 Mar. 2, 2023

(30) Foreign Application Priority Data

Aug. 27, 2021 (JP) ..... 2021-139199

(51) Int. Cl.
*G03G 15/08* (2006.01)

(52) U.S. Cl.
CPC ..... *G03G 15/0806* (2013.01); *G03G 15/0808* (2013.01)

(58) Field of Classification Search
CPC ..... G03G 15/0131; G03G 15/0806; G03G 15/0808; G03G 21/18; G03G 21/1821; G03G 21/186
See application file for complete search history.

(56) References Cited

U.S. PATENT DOCUMENTS

| | | | | |
|---|---|---|---|---|
| 7,062,200 | B2 | 6/2006 | Ueno et al. | |
| 2009/0010689 | A1* | 1/2009 | Koyama | G03G 15/0896 384/255 |
| 2013/0322921 | A1* | 12/2013 | Maeshima | G03G 15/0881 399/111 |
| 2017/0357208 | A1* | 12/2017 | Matsumaru | G03G 15/0131 |

FOREIGN PATENT DOCUMENTS

| | | | |
|---|---|---|---|
| JP | 2005-250310 | A | 9/2005 |
| JP | 2006-064942 | A | 3/2006 |
| JP | 2010-224492 | A | 10/2010 |

* cited by examiner

*Primary Examiner* — Hoang X Ngo
(74) *Attorney, Agent, or Firm* — VENABLE LLP

(57) ABSTRACT

In a developing unit, one of a frame body and an end portion member, which sandwich a bearing member rotatably supporting a developing roller in an axis direction of the developing roller, includes a hole portion depressed in the axis direction on a surface facing the bearing member, and the other of the frame body and the end portion member includes a protruding portion inserted into the hole portion. The protruding portion includes a first region that is press-fitted into an inner wall surface of the hole portion, and a second region that faces the inner wall surface with a gap therebetween, and at least the gap is filled with an adhesive via a communication hole that extends in a direction intersecting the rotation axis direction such that the gap leads to an outside of the frame body.

9 Claims, 20 Drawing Sheets

DEVELOPING UNIT

BACKGROUND OF THE INVENTION

Field of the Invention

The present disclosure relates to a developing unit provided in an image forming apparatus such as a copier or a printer that adopts an electrophotographic system.

Description of the Related Art

As image forming apparatuses such as copiers or printers that adopt an electrophotographic system, apparatuses that adopt a process cartridge system are known. Generally, a process cartridge is configured of a drum unit having a photosensitive drum and a developing unit that supplies a developer to the photosensitive drum, and is configured to be attachable and detachable to/from an apparatus main body. The drum unit generally includes the photosensitive drum, a charging roller for charging the photosensitive drum, a cleaning member for scraping the developer remaining on the photosensitive drum from the photosensitive drum, and a cleaning container that supports the photosensitive drum, the charging roller, and the cleaning member. On the other hand, the developing unit generally includes a developer container, a developer carrying member (a developing roller) that carries and conveys toner included in the developer container, and a layer thickness regulating member (a developing blade) that regulates a toner layer thickness on the developing roller.

In addition, as a method for fixing a frame body and other components, as shown in Japanese Patent Application Laid-open No. 2005-250310, a joining technique in which flow paths are provided at joint portions of a frame body and other components and an adhesive (for example, limonene) is injected thereinto to join each member is adopted.

SUMMARY OF THE INVENTION

However, with the improvement of technology in recent years, reduction in size of image forming apparatuses and cartridges has progressed, and it has become difficult to secure a joining space for joining in bonding with limonene or the like. Further, in a case in which limonene is used, a method for fixing functional materials such as a polyacetal resin not melted with limonene is also an issue.

An object of the present invention is to provide a technique for enabling high strength joining in a limited joining space between constituent members of a unit having a reduced size.

In order to achieve the above object, a developing unit of the present invention includes the following:

a developing roller;

a frame body of which a longitudinal direction is a rotation axis direction of the developing roller;

a bearing member attached to an end portion of the frame body in the rotation axis direction, the bearing member rotatably supporting an end portion of the developing roller in the rotation axis direction; and an end portion member attached to the end portion of the frame body outside the bearing member in the rotation axis direction to sandwich the bearing member together with the frame body;

wherein one of the frame body and the end portion member includes a hole portion that is depressed in the rotation axis direction on a facing surface that faces the bearing member, and the other of the frame body and the end portion member includes a protruding portion that is inserted into the hole portion and extends in the rotation axis direction, the protruding portion includes a first region and a second region that is provided at a position closer to a tip of the protruding portion than the first region is, the first region of the protruding portion being press-fitted into the hole portion, the second region being inserted into the hole portion with a gap between an outer peripheral surface of the protruding portion and an inner peripheral surface of the hole portion, the frame body includes a communication hole that extends in a direction intersecting the rotation axis direction such that the gap leads to an outside of the frame body through the communication hole, and at least a part of the communication hole and the gap are filled with an adhesive.

According to the present invention, it is possible to perform high strength joining in a limited joining space between constituent members of a unit having a reduced size.

Further features of the present invention will become apparent from the following description of exemplary embodiments with reference to the attached drawings.

DESCRIPTION OF THE EMBODIMENTS

In the following examples, embodiments according to the present disclosure will be illustratively described. However, the configurations disclosed in the following examples, for example, functions, materials, shapes of components, and their relative arrangements, show an example of a form related to the scope of claims and are not intended to limit the scope of claims to those disclosed in these examples. Further, the problem to be solved by the configurations disclosed in the following examples or the operations or effects obtained from the disclosed configurations are not intended to limit the scope of claims.

Example 1

An electrophotographic image forming apparatus according to Example 1 of the present disclosure will be described below with reference to the drawings. Here, the electrophotographic image forming apparatus (hereinafter referred to as an image forming apparatus) forms images on a recording material using an electrophotographic image forming system. Examples of the image forming apparatus include a copier, a facsimile apparatus, a printer (a laser light printer, an LED printer, or the like), a multifunction printer thereof, and the like. The recording material includes a sheet-shaped recording medium such as recording paper and a plastic sheet. Further, the image forming apparatus according to the present example is an image forming apparatus that adopts a so-called cartridge system. The cartridge is a unit that is attachable and detachable to/from the image forming apparatus and has a photosensitive member and process unit (for example, a charging member, a developing member, a cleaning member, and the like) that acts on the photosensitive member. In the following examples, a laser light printer to/from which four process cartridges (cartridges) are attachable and detachable is exemplified as an image forming apparatus. Also, the number of process cartridges mounted on the image forming apparatus is not limited thereto. It may be appropriately set as necessary.

Outline Configuration of Image Forming Apparatus

Figure 2:
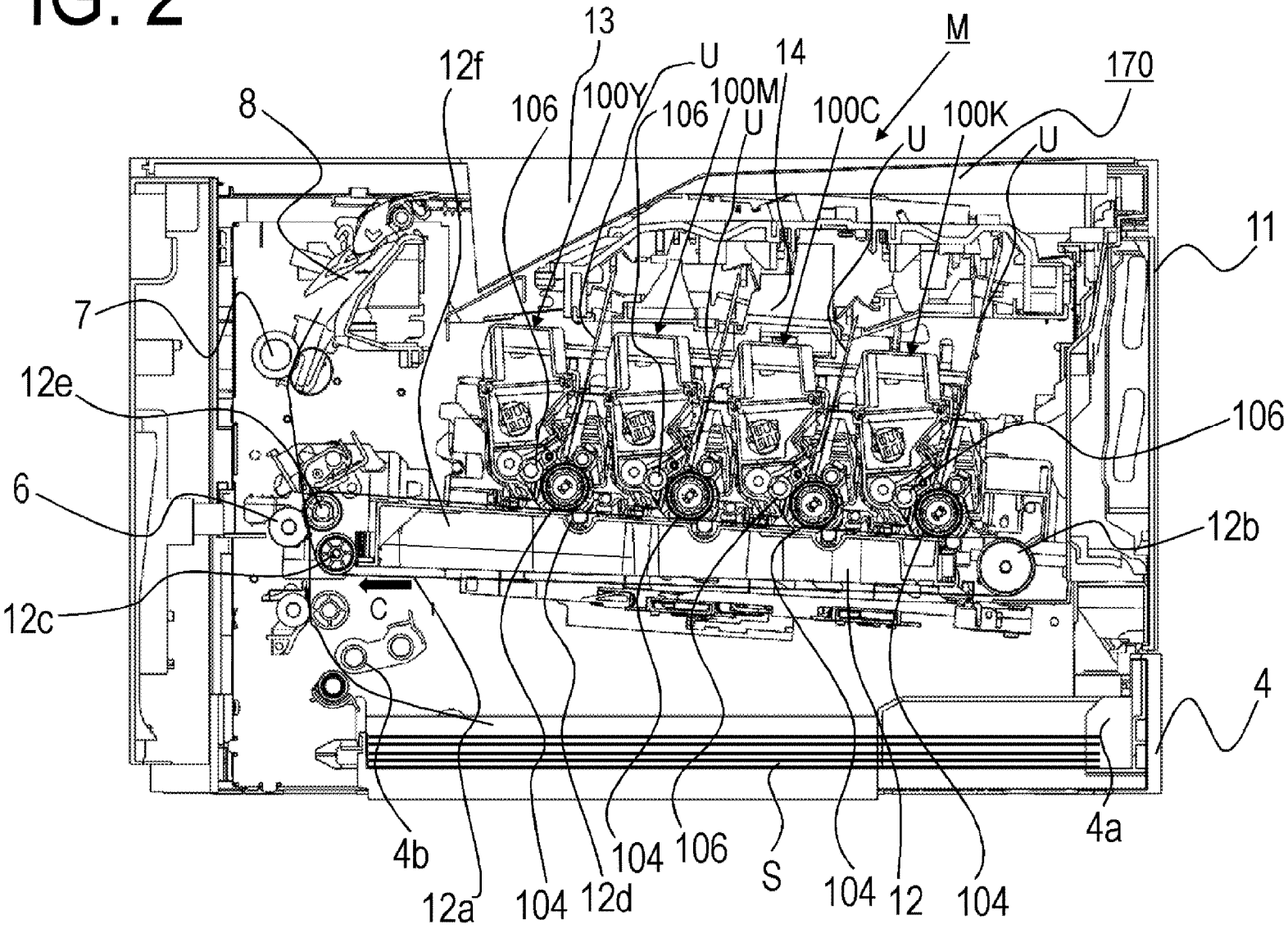
FIG. 2 is a cross-sectional view of an image forming apparatus of Example 1.
Figure 3:
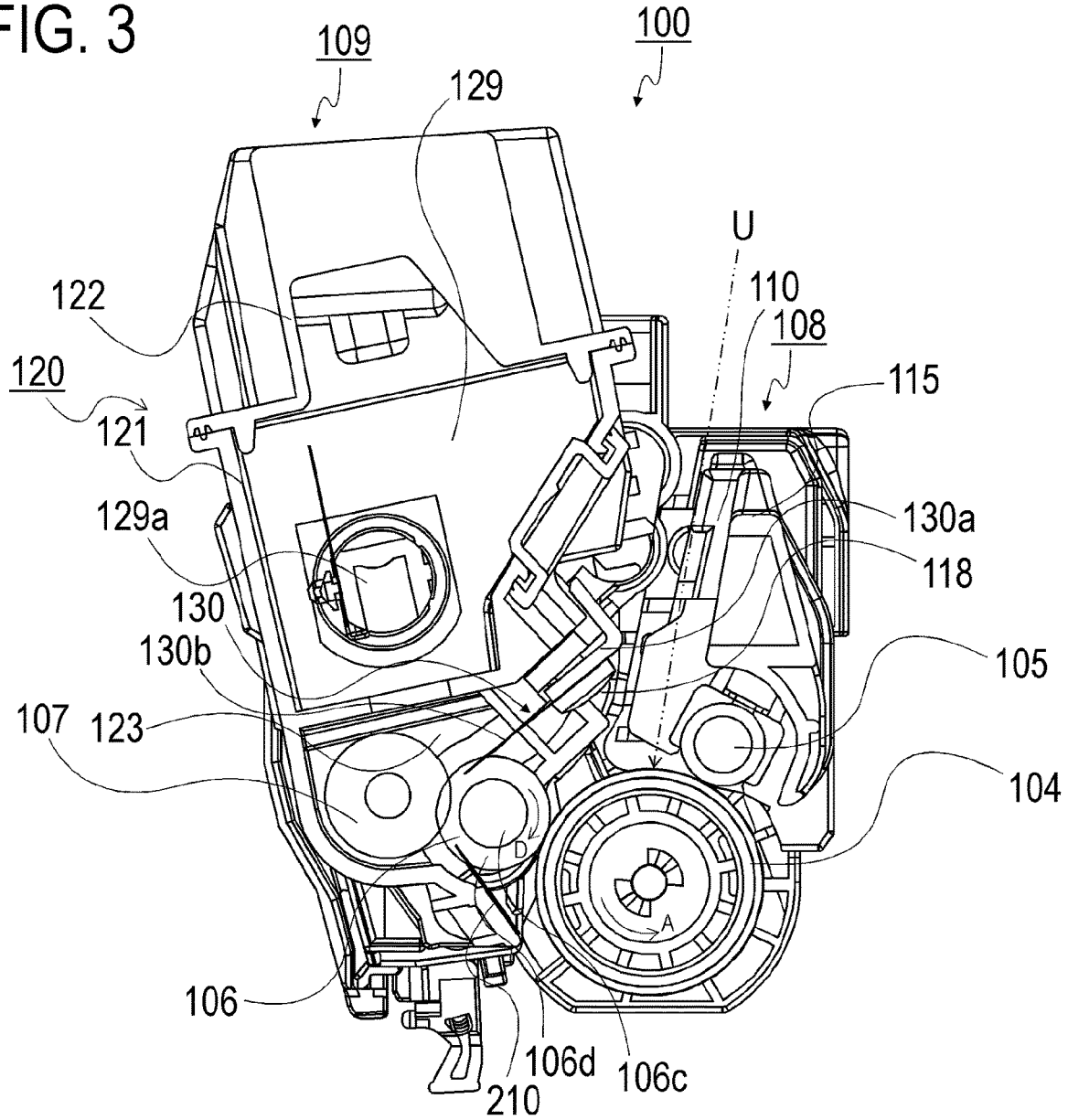
FIG. 3 is a cross-sectional view of a process cartridge of Example 1.

FIG. 2 is a cross-sectional view schematically showing a configuration of an image forming apparatus M according to the present example. Also, FIG. 3 is a cross-sectional view schematically showing a configuration of a process cartridge 100. The image forming apparatus M is a full four-color laser printer using an electrophotographic process and performs color image formation on recording media S. The image forming apparatus M is a process cartridge type, and the process cartridge 100 is detachably mounted on an image forming apparatus main body (an apparatus main body) 170 to form color images on the recording media S.

Here, in the image forming apparatus M, a side on which a front door 11 is provided is defined as a front side (a front surface), and a surface on a side opposite to the front surface is defined as a back surface (a rear surface). In addition, a right side of the image forming apparatus M when viewed from the front is referred to as a driving side, and a left side thereof is referred to as a non-driving side. Further, when the image forming apparatus M is viewed from the front, an upper side thereof is defined as an upper surface and a lower side thereof is defined as a lower surface. FIG. 2 is a cross-sectional view of the image forming apparatus M from the non-driving side, in which a side in front of the paper surface is defined as the non-driving side of the image forming apparatus M, a right side of the paper surface is defined as the front side of the image forming apparatus M, and a side behind the paper surface is defined as the driving side of the image forming apparatus M.

Further, the driving side of the process cartridge 100 is a side on which a drum coupling member (a photosensitive member coupling member), which will be described later, is disposed in an axis direction of a photosensitive drum (an axis direction of a rotation axis of the photosensitive drum). Also, the driving side of the process cartridge 100 is a side on which a developing coupling portion 132*a* (FIG. 10), which will be described later, is disposed in an axis direction of a developing roller (a developing member) (an axis direction of a rotation axis of the developing roller). In addition, the axis direction of the photosensitive drum and the axis direction of the developing roller are parallel, and a longitudinal direction of the process cartridge 100 is also parallel to these.

Four process cartridges 100 (100Y, 100M, 100C, and 100K) are disposed in the apparatus main body 170 (hereinafter, the apparatus main body 170) in a substantially horizontal direction. That is, there are four process cartridges: a first process cartridge 100Y, a second process cartridge 100M, a third process cartridge 100C, and a fourth process cartridge 100K.

The first to fourth process cartridges 100 (100Y, 100M, 100C, and 100K) have the same electrophotographic process mechanism, but have developers (hereinafter referred to as toner) having different colors from each other. A rotational driving force is transmitted to the first to fourth process cartridges 100 (100Y, 100M, 100C, and 100K) from a drive output portion (details thereof will be described later) of the apparatus main body 170. Also, a bias voltage (a charging bias, a developing bias, or the like) is supplied from the apparatus main body 170 to each of the first to fourth process cartridges 100 (100Y, 100M, 100C, and 100K).

As shown in FIG. 3, each of the first to fourth process cartridges 100 (100Y, 100M, 100C, and 100K) of the present example has a drum unit 108 that includes a photosensitive drum 104 and a charging portion serving as a process unit that acts on the photosensitive drum 104. Here, the drum unit 108 may have, as a process unit, a cleaning unit as well as a charging unit. Further, each of the first to fourth process cartridges 100 (100Y, 100M, 100C, and 100K) has a developing unit 109 including a developing portion for developing an electrostatic latent image on the photosensitive drum 104. A layout of the electrophotographic image forming apparatus in which a plurality of photosensitive drums 104 are arranged substantially in a row in this way is sometimes called an in-line layout or a tandem layout.

In each of the first to fourth process cartridges 100, the drum unit 108 and the developing unit 109 are coupled to each other. A more specific configuration of the process cartridges 100 will be described later.

The first process cartridge 100Y contains yellow (Y) toner in a developer container 120 and forms a yellow toner image on a surface of the photosensitive drum 104. The second process cartridge 100M contains magenta (M) toner in a developer container 120 and forms a magenta-colored toner image on a surface of the photosensitive drum 104. The third process cartridge 100C contains a cyan (C) toner in a developer container 120 and forms a cyan-colored toner image on a surface of the photosensitive drum 104. The fourth process cartridge 100K contains black (K) toner in a developer container 120 and forms a black toner image on a surface of the photosensitive drum 104.

As shown in FIG. 2, a laser scanner unit 14 serving as an exposure unit is provided above the first to fourth process cartridges 100 (100Y, 100M, 100C, and 100K). The laser scanner unit 14 outputs laser light U in response to image information. Then, the laser light U passes through an exposure window 110 (see FIG. 3) of the process cartridge 100 and scans and exposes the surface of the photosensitive drum 104.

An intermediate transfer unit 12 serving as a transfer member is provided below the first to fourth process cartridges 100 (100Y, 100M, 100C, and 100K). The intermediate transfer unit 12 has a drive roller 12*e*, a turn roller 12*c*, and a tension roller 12*b*, and a flexible transfer belt 12*a* is hung thereon. A lower region of a circumferential surface of the photosensitive drum 104 of each of the first to fourth process cartridges 100 (100Y, 100M, 100C, and 100K) is in contact with an upwardly facing region of an outer peripheral surface of the annular transfer belt 12*a*. The contact portion is a primary transfer portion. A primary transfer roller 12*d* is provided on an inner side of the transfer belt 12*a* to face the photosensitive drum 104. A secondary transfer roller 6 abuts the turn roller 12*c* via the transfer belt 12*a*. A contact portion between the transfer belt 12*a* and the secondary transfer roller 6 is a secondary transfer portion.

A feeding unit 4 is provided below the intermediate transfer unit 12. The feeding unit 4 has a paper feeding tray 4*a*, in which a recording medium S is loaded and stored, and a paper feeding roller 4*b*. A conveyance path of the recording medium S is configured to be directed substantially upward from the feeding unit 4 on a back surface side of the apparatus in the apparatus main body 170.

A fixing apparatus 7 and a paper discharging apparatus 8 are provided on a downstream side of the secondary transfer portion (on an upper left side in the apparatus main body 170 in FIG. 2) in the conveyance path of the recording media S. An upper surface of the apparatus main body 170 is formed as a paper discharging tray 13. The recording media S are heated and pressurized by a fixing portion provided in the fixing apparatus 7 to fix toner images thereon and is discharged to the paper discharging tray 13.

Image Forming Operation

An operation for forming a full color image is as follows. The photosensitive drum 104 of each of the first to fourth process cartridges 100 (100Y, 100M, 100C, and 100K) is rotationally driven at a predetermined speed (in a direction of arrow A in FIG. 3). The transfer belt 12*a* is also rotationally driven in a forward direction (in a direction of arrow C in FIG. 2) with respect to the rotation of the photosensitive drum 104 at a speed corresponding to the speed of the photosensitive drum 104.

The laser scanner unit 14 is also driven. In synchronization with the drive of the laser scanner unit 14, a charging roller 105 uniformly charges the surface of the photosensitive drum 104 to a predetermined polarity and potential in each process cartridge 100. The laser scanner unit 14 scans and exposes the surface of each photosensitive drum 104 with laser light U in accordance with an image signal of each color. Thus, an electrostatic latent image corresponding to the image signal of the corresponding color is formed on the surface of each photosensitive drum 104. The formed electrostatic latent image is developed by a developing roller 106 that is rotationally driven at a predetermined speed. Due to such an electrophotographic image forming process operation, a yellow toner image corresponding to a yellow component of the full color image is formed on the photosensitive drum 104 of the first process cartridge 100Y. Then, the toner image is primarily transferred onto the transfer belt 12*a*.

Similarly, a magenta-colored toner image corresponding to a magenta component of the full color image is formed on the photosensitive drum 104 of the second process cartridge 100M. Then, the toner image is superimposed and primarily transferred on the yellow toner image already transferred on the transfer belt 12*a*. Similarly, a cyan-colored toner image corresponding to a cyan component of the full color image is formed on the photosensitive drum 104 of the third process cartridge 100C. Then, the toner image is superimposed and primarily transferred on the yellow and magenta-colored toner images already transferred on the transfer belt 12*a*. Similarly, a black toner image corresponding to a black component of the full color image is formed on the photosensitive drum 104 of the fourth process cartridge 100K. Then, the toner image is superimposed and primarily transferred on the yellow, magenta-colored, and cyan-colored toner images already transferred on the transfer belt 12*a*. In this way, an unfixed full four-color toner image of yellow, magenta, cyan, and black is formed on the transfer belt 12*a*.

On the other hand, the recording media S are separated and fed one by one at predetermined control timings. The recording media S are introduced into the secondary transfer portion, which is the contact portion between the secondary transfer roller 6 and the transfer belt 12*a*, at predetermined control timings. Thus, in the process of conveying the recording media S to the secondary transfer portion, the toner images on the transfer belt 12*a*, on which the four colors are superimposed, are sequentially and collectively transferred to surfaces of the recording media S. After that, the recording media S are conveyed to the fixing apparatus 7 to fix the toner images on the recording media S, and then are discharged to the paper discharging tray 13.

Outline of Attachment and Detachment Configuration of Process Cartridge

Figure 4:
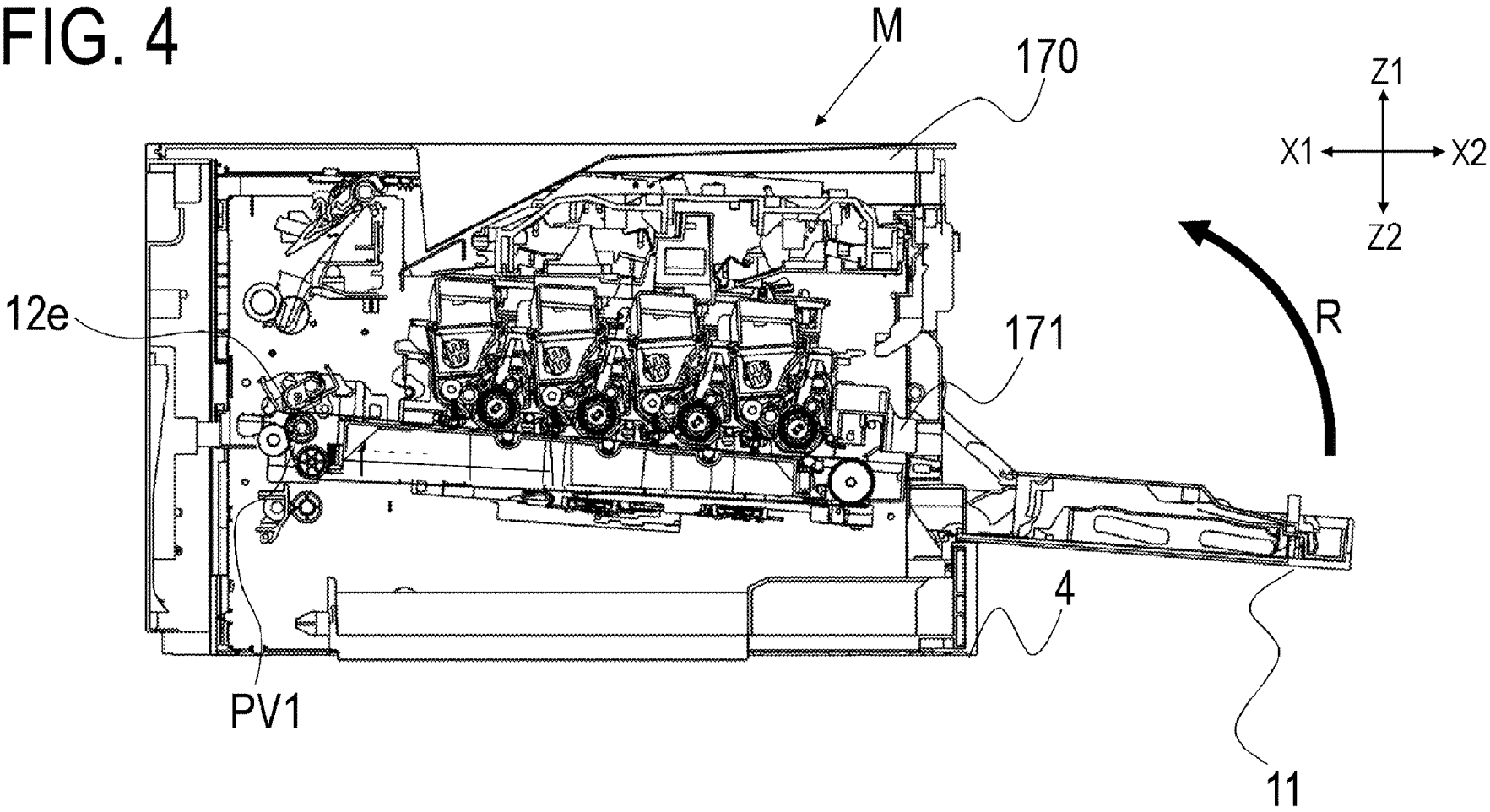
FIG. 4 is a cross-sectional view of the image forming apparatus of Example 1.
Figure 5:
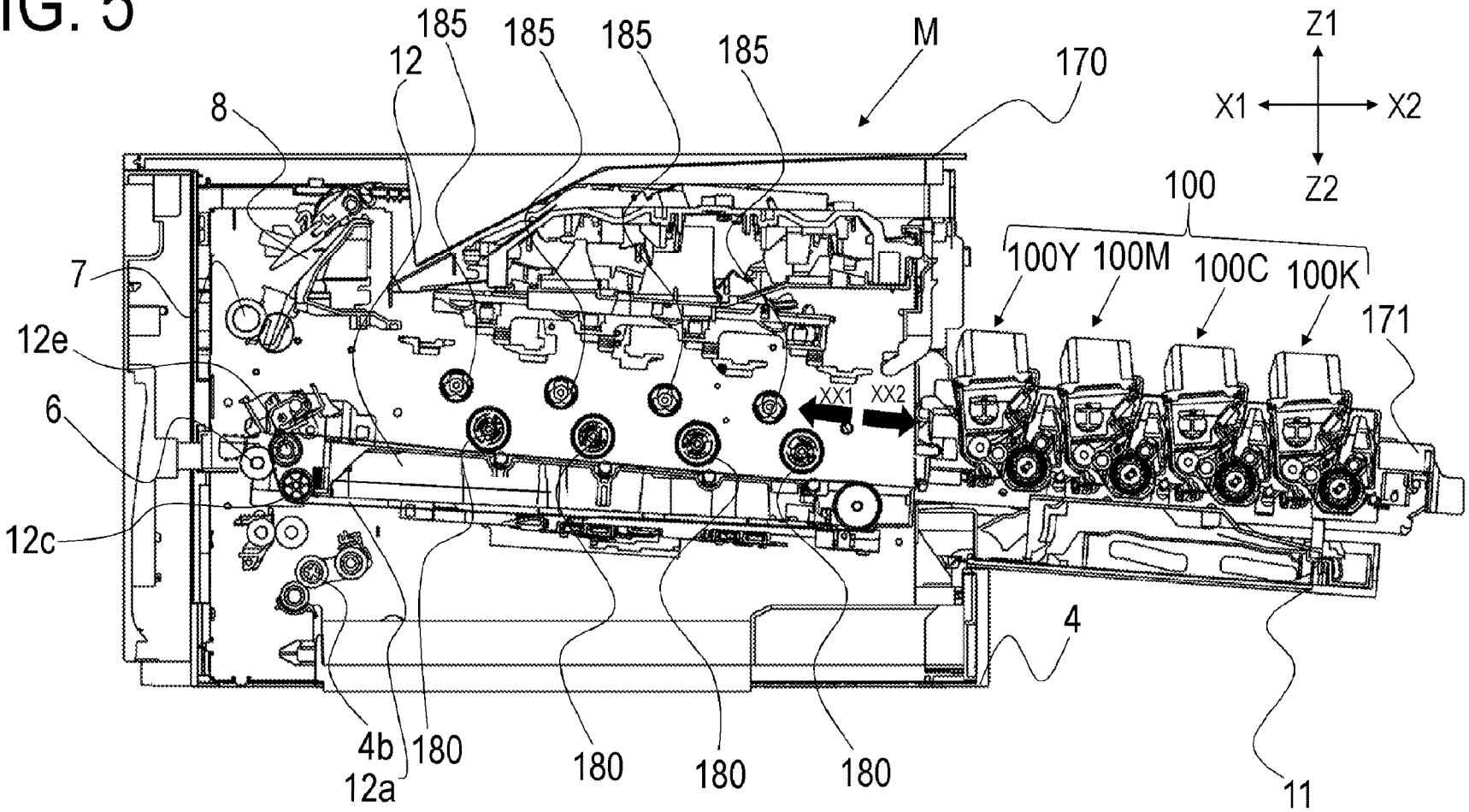
FIG. 5 is a cross-sectional view of the image forming apparatus of Example 1.
Figure 6:
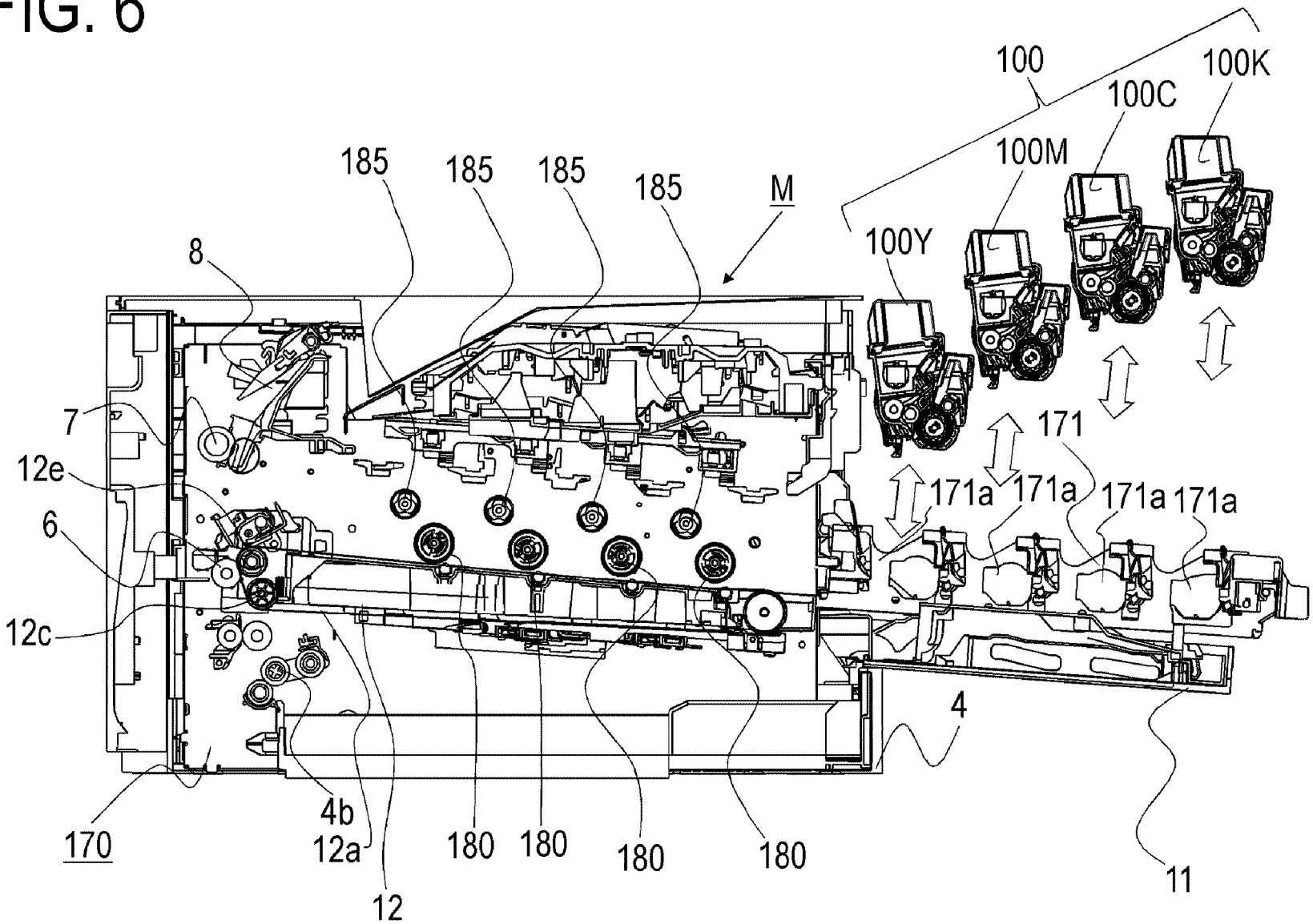
FIG. 6 is a cross-sectional view of the image forming apparatus of Example 1.
Figure 7B:
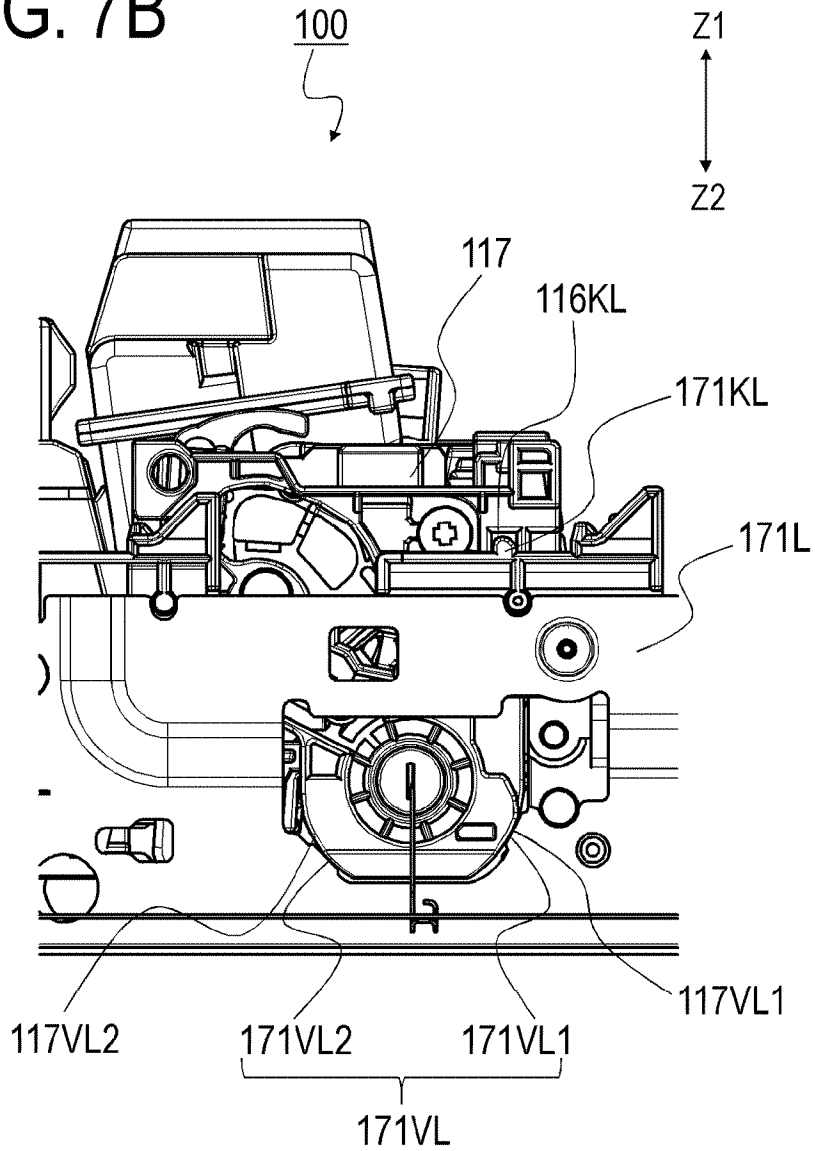
FIGS. 7A and 7B are partially enlarged views of a tray.
Figure 7A:
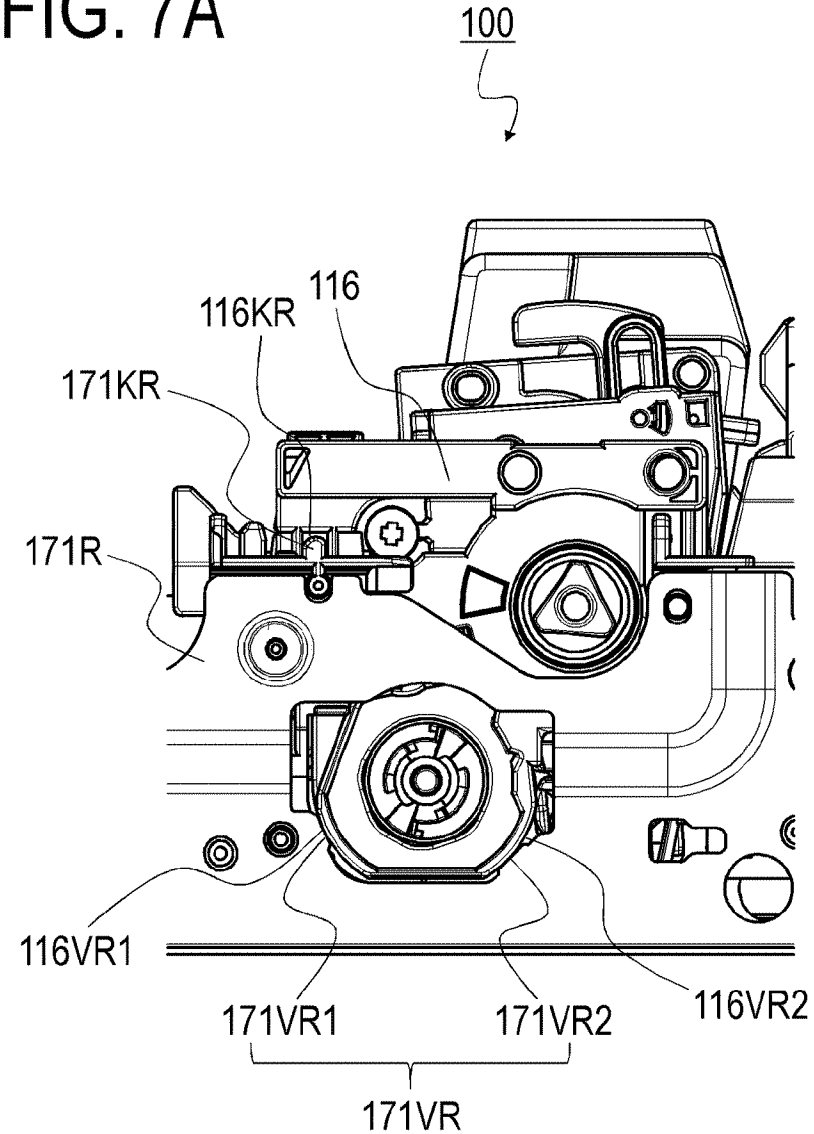

A tray (hereinafter referred to as a tray) 171 that supports the process cartridge will be described in more detail with reference to FIGS. 2, and 4 to 7A and 7B. FIG. 4 is a cross-sectional view of the image forming apparatus M in which the tray 171 is located inside the apparatus main body 170 with the front door 11 open. FIG. 5 is a cross-sectional view of the image forming apparatus M in a state in which the tray 171 is located outside the apparatus main body 170 and the process cartridge 100 is housed inside the tray 171 with the front door 11 open. FIG. 6 is a cross-sectional view of the image forming apparatus M in a state in which the tray 171 is located outside the apparatus main body 170 and the process cartridge 100 is removed from the tray 171 with the front door 11 open. FIG. 7A is a partial detailed view of the tray 171 from the driving side in the state of FIG. 4. FIG. 7B is a partial detailed view of the tray 171 from the non-driving side in the state of FIG. 4.

As shown in FIGS. 4 and 5, the tray 171 is movable relative to the apparatus main body 170 in a direction of arrow X1 (a pushing direction) and a direction of arrow X2 (a pulling direction), which are a front to rear direction of the apparatus. That is, the tray 171 is provided to be able to be pulled out and pushed into the apparatus main body 170, and the tray 171 is configured to be movable in the substantially horizontal direction in a state in which the apparatus main body 170 is installed on a horizontal plane. Here, the state in which the tray 171 is located outside the apparatus main body 170 (the state of FIG. 5) is referred to as an outer position. In addition, the state in which the tray 171 is located inside the apparatus main body 170 with the front door 11 open and the photosensitive drum 104 and the transfer belt 12*a* are separated from each other (the state of FIG. 4) is referred to as an inner position.

Further, the tray 171 has mounting portions 171*a* in which the process cartridges 100 can be detachably mounted as shown in FIG. 6 at the outer position. Then, as shown in FIGS. 7A and 7B, each process cartridge 100 mounted on the mounting portion 171*a* at the outer position of the tray 171 is supported on the tray 171 by a driving side cartridge cover member 116 and a non-driving side cartridge cover member 117. Then, the process cartridges 100 move to the inside of the apparatus main body 170 with the movement of the tray 171 in a state in which they are disposed in the mounting portions 171*a*. In this case, they move with gaps between the transfer belt 12*a* and the photosensitive drums 104. For this reason, the tray 171 can move the process cartridges 100 to the inside of the apparatus main body 170 without the photosensitive drums 104 coming into contact with the transfer belt 12*a* (details thereof will be described later).

As described above, the tray 171 allows the plurality of process cartridges 100 to be collectively moved to positions at which images can be formed in the apparatus main body 170 and can be collectively pulled out to the outside of the apparatus main body 170.

Positioning of Process Cartridge

Positioning of the process cartridge 100 with respect to the apparatus main body 170 will be described in more detail with reference to FIGS. 7A and 7B. As shown in FIGS. 7A and 7B, the tray 171 has a right tray portion 171R that supports the driving side (a longitudinally right side) of the process cartridge 100, and a left tray portion 171L that supports the non-driving side (a longitudinally left side). The right tray portion 171R and the left tray portion 171L are respectively provided with positioning portions 171VR and 171VL for holding the cartridge 100. The positioning portion 171VR has straight portions 171VR1 and 171VR2.

As shown in FIG. 7A, a center of the photosensitive drum is determined by arc portions 116VR1 and 116VR2 of the driving side cartridge cover member 116 coming into contact with the straight portions 171VR1 and 171VR2. Also, as shown in FIG. 7A, the right tray portion 171R has a rotation determining protruding portion 171KR. As shown in FIG. 7A, a posture of the process cartridge 100 is determined with respect to the apparatus main body 170 by fitting the rotation determining protruding portion 171KR to a rotation determining depressed portion 116KR of the driving side cartridge cover member 116.

The positioning portion 171VL and a rotation determining protruding portion 171KL are disposed at positions (a non-driving side) facing the positioning portion 171VR with the intermediate transfer belt 12*a* interposed therebetween in the longitudinal direction of the process cartridge 100. The positioning portion 171VL has straight portions 171VL1 and 171VL2. As shown in FIG. 7B, the center of the photosensitive drum is determined by arc portions 117VL1 and 117VL2 of the cartridge cover member 117 coming into contact with the straight portions 171VL1 and 171VL2. Further, as shown in FIG. 7B, the left tray portion 171L has the rotation determining protruding portion 171KL. As shown in FIG. 7B, the posture of the process cartridge 100 is determined with respect to the apparatus main body 170 by fitting the rotation determining protruding portion 171KL to a rotation determining depressed portion 117KL of the non-driving side cartridge cover member 117.

With the above configuration, a position of the process cartridge 100 is correctly determined with respect to the tray 171. Then, as shown in FIG. 5, the process cartridge 100 integrated with the tray 171 is moved in the direction of arrow X1 and inserted to the position shown in FIG. 4. Then, by closing the front door 11 in a direction of arrow R, the process cartridge 100 is pressed by a cartridge pressing mechanism (not shown), which will be described later, and is fixed to the apparatus main body 170 together with the tray 171. Further, the transfer belt 12*a* comes into contact with a photosensitive member 4 in conjunction with an operation of the cartridge pressing mechanism. By reaching this state, the apparatus is in a state in which an image is formed (FIG. 2).

Also, in the present example, since the positioning portion 171VR and the positioning portion 171VL also serve as reinforcements for maintaining rigidity in a pulling out operation of the tray 171, they are manufactured by metal sheet metal, but the present invention is not limited thereto.

Cartridge Pressing Mechanism

Figure 8A:
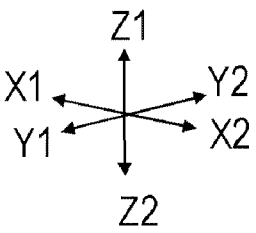
FIGS. 8A and 8B are perspective views of a storage element pressing unit and a cartridge pressing unit.
Figure 8A:
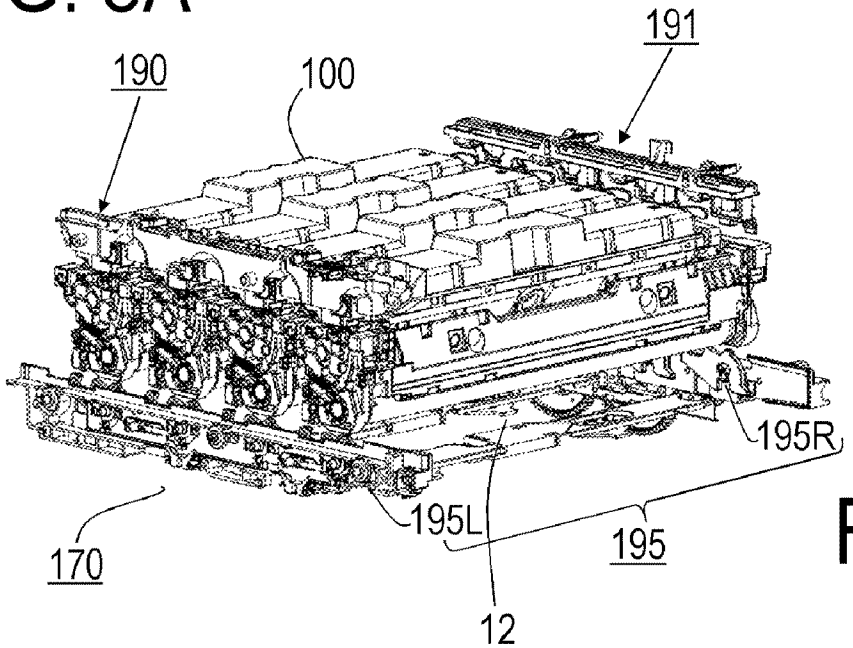
Figure 8B:
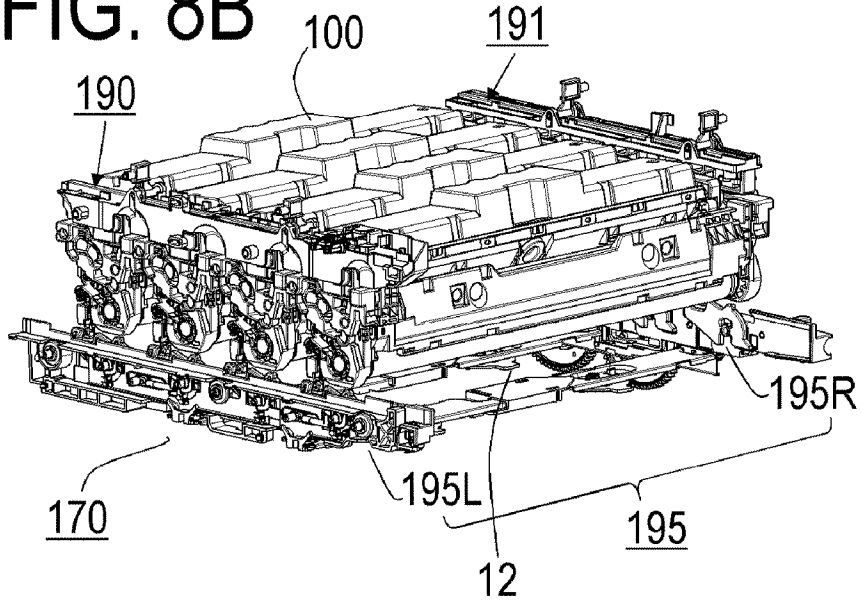

Details of the cartridge pressing mechanism will be described with reference to FIGS. 8A, 8B, and 13. FIG. 8A is a perspective view showing only the process cartridge 100, the tray 171, cartridge pressing mechanisms 190 and 191, and the intermediate transfer unit 12 in a state in which the front door 11 is open as shown in FIG. 4. FIG. 8B is a perspective view showing only the process cartridge 100, the tray 171, the cartridge pressing mechanisms 190 and 191, and the intermediate transfer unit 12 in a state in which the front door 11 is closed as shown in FIG. 2.

Here, the process cartridge 100 receives a driving force during image formation and further receives a reaction force from the primary transfer roller 12*d* (FIG. 2) in the direction of arrow Z1 as well. For that reason, it is required to press the process cartridge in the Z2 direction in order to maintain a stable posture without the process cartridge floating from the positioning portions 171VR and 171VL (see FIGS. 7A and 7B) during the image forming operation. In order to achieve this, in the present example, the apparatus main body 170 is provided with the cartridge pressing mechanisms 190 and 191. In the cartridge pressing mechanisms 190 and 191, a storage element pressing unit 190 is responsible for the non-driving side, and a cartridge pressing unit 191 is responsible for the driving side. This will be described in more detail below.

By closing the front door 11 as shown in FIG. 4, the storage element pressing unit 190 and the cartridge pressing unit 191 shown in FIGS. 8A and 8B descend in a direction of arrow Z2. The storage element pressing unit 190 mainly has a main body side electric contact (not shown) that comes into contact with an electric contact of a storage element (not shown) provided in the process cartridge 100. It is configured such that, by interlocking with the front door 11 using a link mechanism (not shown), the storage element 140 and the main body side electric contact can be contacted and non-contacted. That is, the contacts are configured to abut each other by closing the front door 11 and to be separated from each other by opening the front door 11. With the above configuration, it is configured such that, when the process cartridge 100 moves inside the image forming apparatus main body together with the tray 171, the electric contacts are not rubbed and the contacts are retracted from an insertion and removal locus of the process cartridge 100, and thus insertion and removal of the tray 171 is not hindered. The storage element pressing unit 190 also plays a role of pressing the process cartridge 100 against the positioning portion 171VR described above. In addition, similarly to the storage element pressing unit 190, the cartridge pressing unit 191 also descends in the direction of arrow Z2 in conjunction with the operation of closing the front door 11 and plays a role of pressing the process cartridge 100 against the positioning portion 171VL described above. Further, although the details will be described later, the cartridge pressing mechanisms 190 and 191 also play a role of pressing down moving members 152L and 152R (a moving member 152L is not shown) of the process cartridge 100, which will be described later.

Drive Transmission Mechanism

Figure 9B:
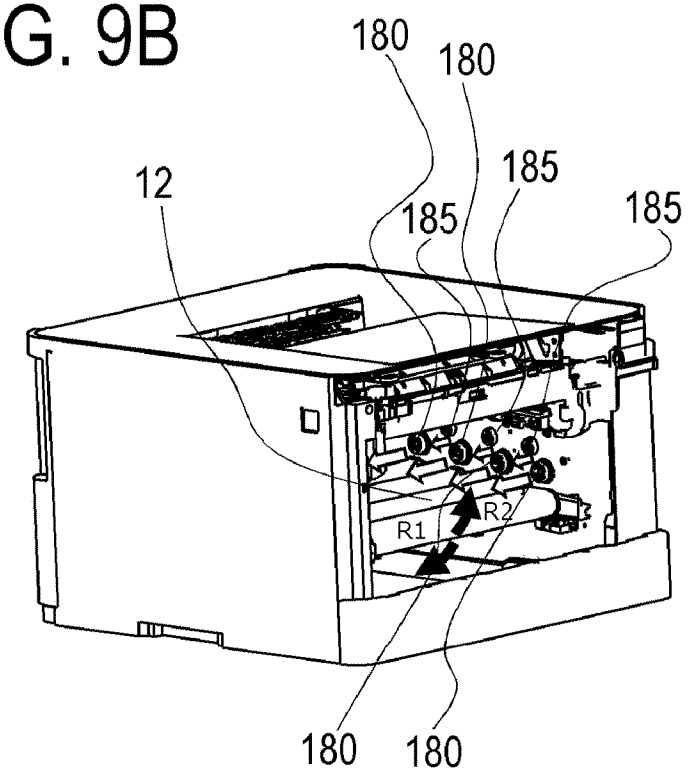
FIGS. 9A and 9B are perspective views of the image forming apparatus of Example 1.
Figure 9A:
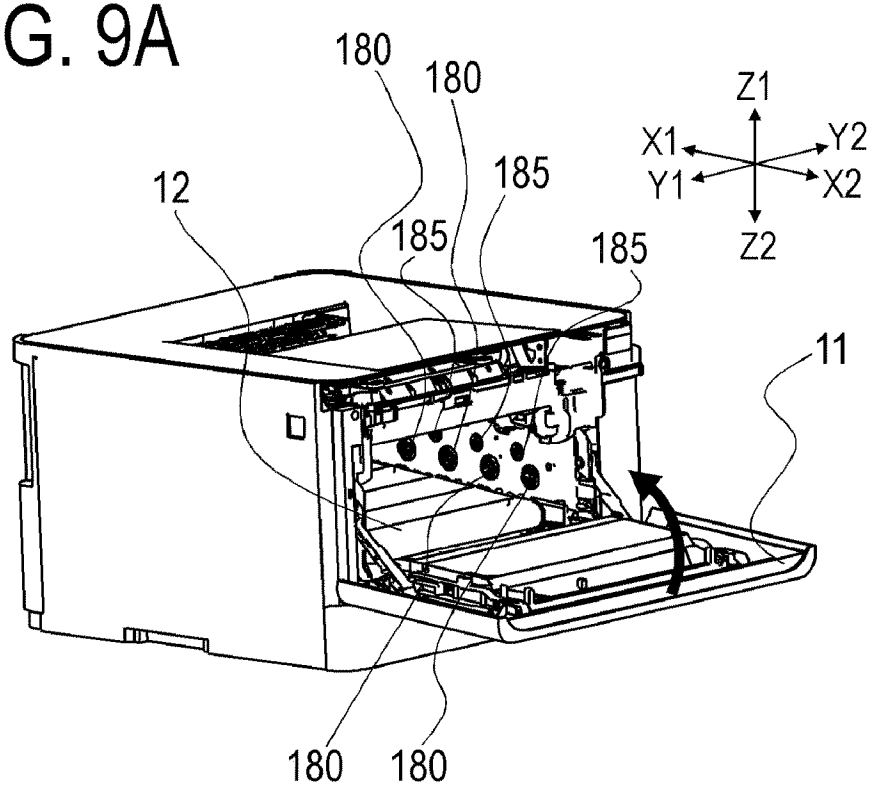
Figure 10:
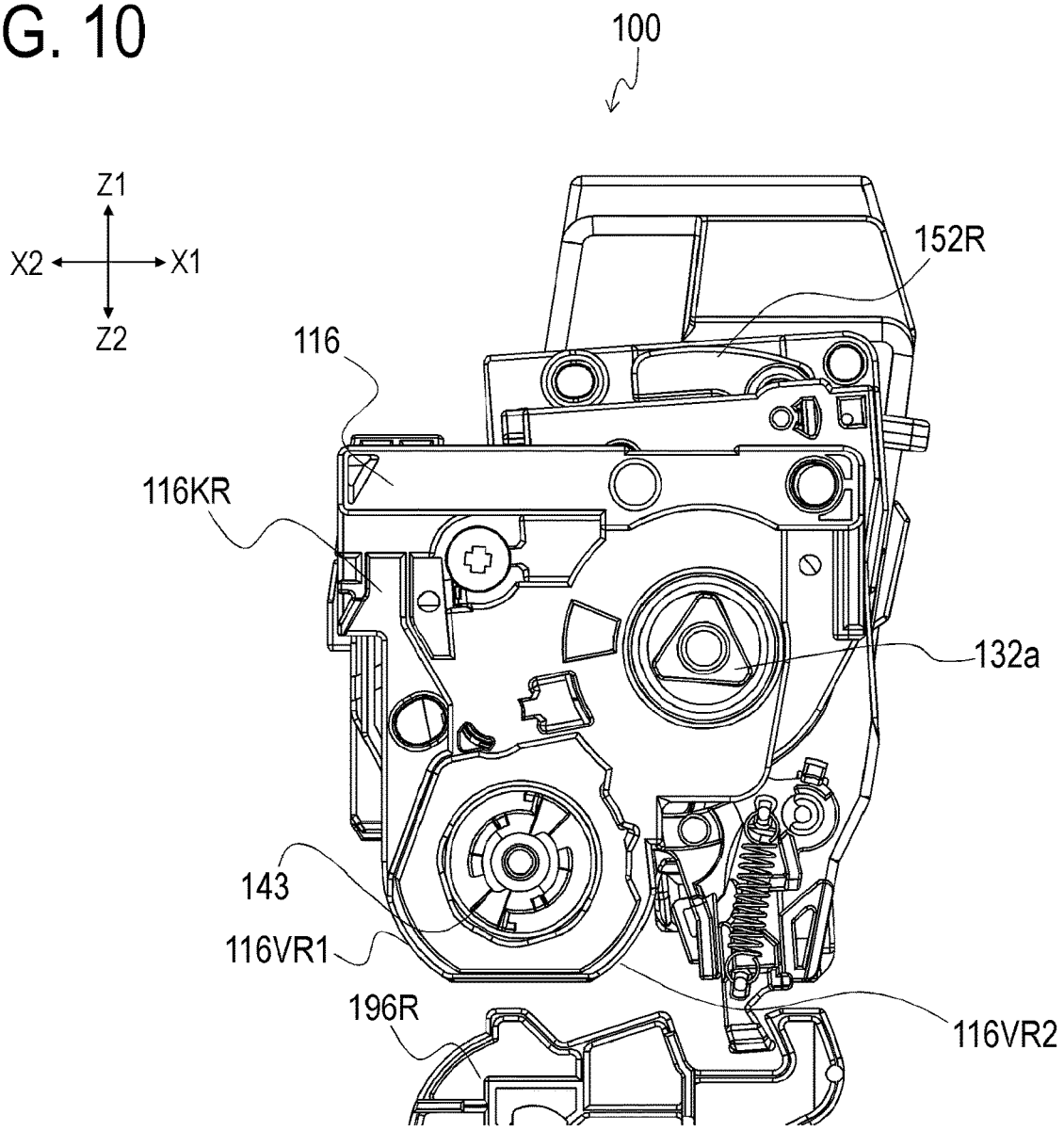
FIG. 10 is a side view of the process cartridge of Example 1.

A drive transmission mechanism of the main body in the present example will be described with reference to FIGS. 9A, 9B, and 10. FIG. 9A is a perspective view of the state of FIG. 4 or 5 in which illustration of the process cartridge 100 and the tray 171 is omitted. FIG. 9B is a perspective view of the state of FIG. 2 in which illustration of the process cartridge 100, the front door 11, and the tray 171 are omitted. FIG. 10 is a side view of the process cartridge 100 from the driving side and shows a state in which the moving member 152R of the process cartridge 100 is pressed down by a cartridge pressing mechanism (not shown) and engages with a separation control member 196R to overlap each other, which will be described later.

As shown in FIG. 10, the process cartridge in the present example has a developing coupling portion (a rotational driving force receiving portion) 132*a* and a drum coupling member (a photosensitive member coupling member) 143. It is configured such that, by closing the front door 11 (the state of FIG. 9B), a main body side drum drive coupling 180 and a main body side developing drive coupling 185, which transmits the drive to the process cartridge 100, protrude in a direction of arrow Y1 due to a link mechanism (not shown). Further, it is configured such that, by opening the front door 11 (the state of FIG. 9A), the drum drive coupling 180 and the developing drive coupling 185 retract in a direction of arrow Y2. It is configured such that, by retracting each coupling from the insertion and removal locus (X1 and X2 directions) of the process cartridge, the above-mentioned insertion and removal of the tray 171 is not hindered.

By closing the front door 11 and starting the drive of the apparatus main body 170, the above-mentioned drum drive coupling 180 engages with the drum coupling member 143. Further, the main body side developing drive coupling 185 engages with the developing coupling portion 132*a*, and the drive is transmitted to the process cartridge 100. Also, the drive transmission to the process cartridge 100 is not limited to two places as described above, and a mechanism in which the drive is input only to the drum coupling and the drive is transmitted to the developing roller therefrom may be provided.

Configuration of Intermediate Transfer Unit

The intermediate transfer unit 12 of the image forming apparatus main body in the present example will be described with reference to FIGS. 9A and 9B. In the present example, the intermediate transfer unit 12 is configured to ascend in a direction of arrow R2 due to a link mechanism (not shown) by closing the front door 11 and move to the position at the time of image formation (a position at which the photosensitive drum 104 and the intermediate transfer belt 12*a* come into contact with each other). Further, by opening the front door 11, the intermediate transfer unit 12 descends in a direction of arrow R1, and the photosensitive drum 2 and the intermediate transfer belt 12*a* are separated from each other. That is, in a state in which the process cartridge 100 is set in the tray 171, the photosensitive drum 104 and the intermediate transfer belt 12*a* are separated from each other and abut each other in accordance with opening and closing operations of the front door 11.

Also, the abutment and separation operations are configured to cause the intermediate transfer unit 12 to ascend and descend while drawing a rotation locus centered on a center point PV1 shown in FIG. 4. Further, the intermediate transfer belt 12*a* is driven by receiving a force from a gear (not shown) disposed coaxially with the PV1. For that reason, by setting the above-mentioned position PV1 as the rotation center, the intermediate transfer unit 12 can ascend and descend without moving a center of the gear. This eliminates the need to move the center of the gear and makes it possible to maintain a position of the gear with high accuracy.

With the above configuration, when the tray 11 is inserted or removed with the process cartridge 100 set in the tray 171, the photosensitive drum 104 and the intermediate transfer belt 12*a* do not slide, and image deterioration due to scratches on the photosensitive drum 104 and charging memories is prevented.

Development Separation Control Unit

Figure 11:
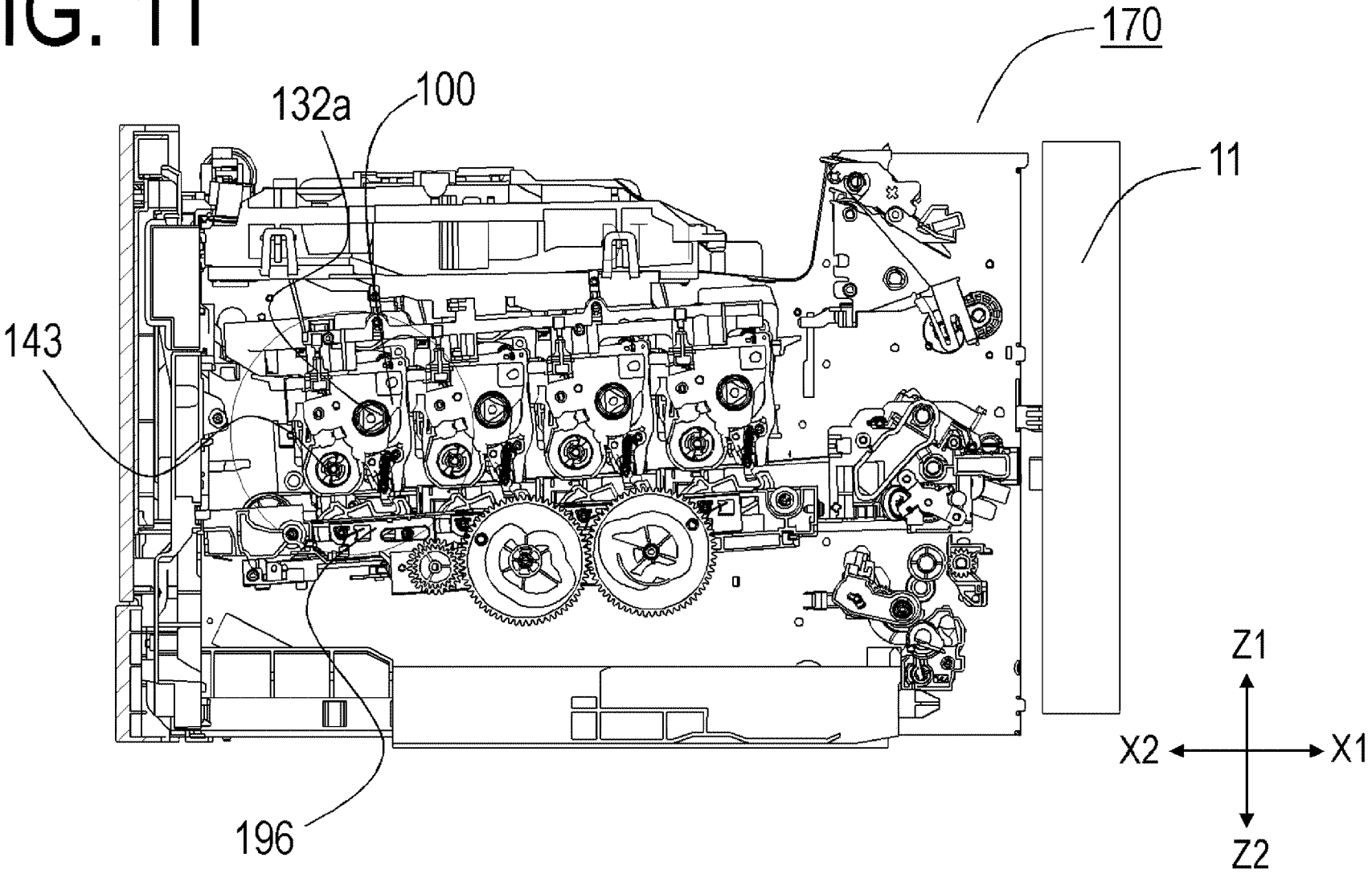
FIG. 11 is a cross-sectional view of the image forming apparatus of Example 1.
Figure 12B:
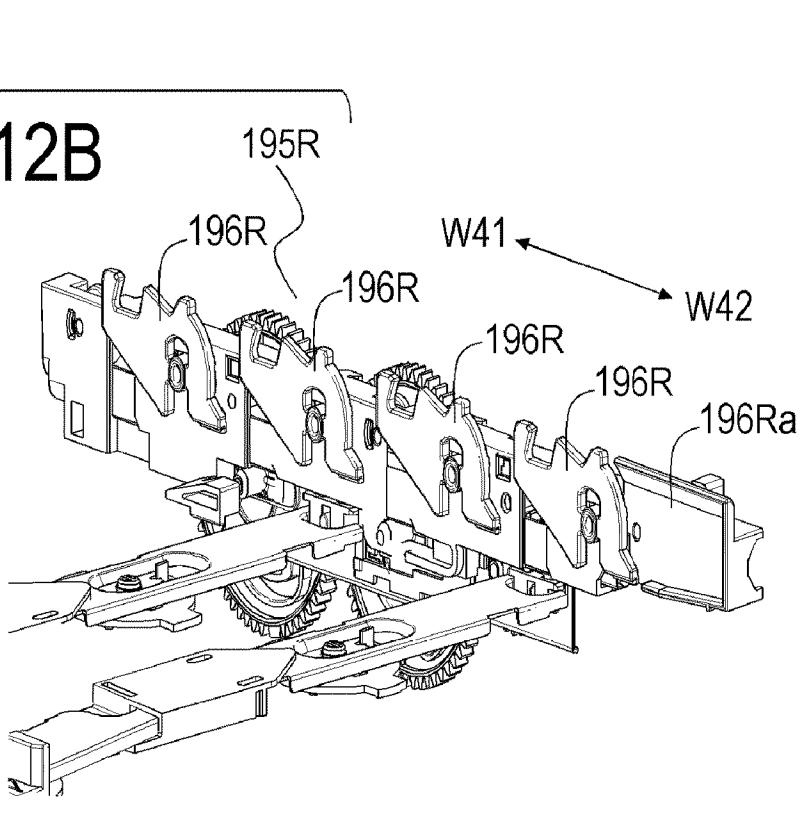
FIGS. 12A and 12B are perspective views of a development separation control unit.
Figure 12A:
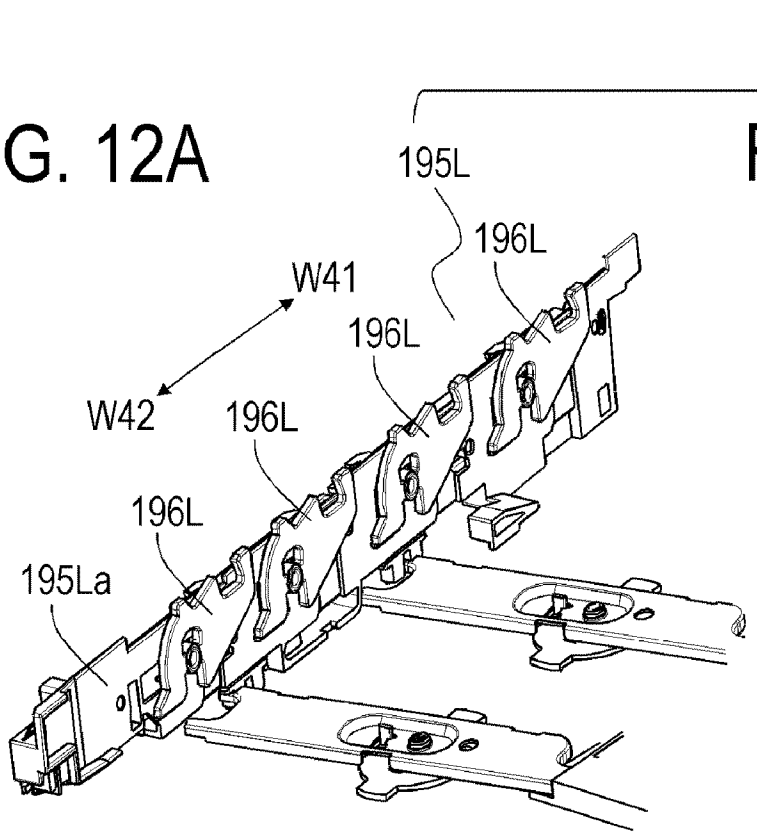

A separation mechanism of the image forming apparatus main body in the present example will be described with reference to FIGS. 8A, 8B, 11, 12A, and 12B. FIG. 11 is a cross-sectional view of the image forming apparatus M cut at a driving side end face of the process cartridge 100. FIGS. 12A and 12B are perspective views of the development separation control unit from diagonally above. In the present example, the development separation control unit 195 controls separation and abutment operations of the developing unit 109 with respect to the photosensitive drum 104 by being engaged with a part of the developing unit 109. As shown in FIGS. 8A and 8B, the development separation control unit 195 is located below the apparatus main body 170. Specifically, the development separation control unit 195 is disposed below the developing coupling portion 132*a* and the drum coupling member 143 in a vertical direction (downward in the direction of arrow Z2). Further, the development separation control unit 195 is disposed on both sides of the intermediate transfer belt 12*a* in a longitudinal direction (Y1 and Y2 directions) of the photosensitive drum 104. That is, the development separation control unit 195 has a development separation control unit 195R on the driving side and a development separation control unit 195L on the non-driving side.

The development separation control unit 195R has four separation control members (force applying members) 196R corresponding to the process cartridges 100 (100Y, 100M, 100C, and 100K). The four separation control members have substantially the same shape. A fixing plate 195Ra is always fixed to the image forming apparatus main body. The separation control member 196R is configured to be movable in W41 and W42 directions by a control mechanism (not shown). The W41 and W42 directions are substantially parallel to an arrangement direction of the process cartridges 100 mounted on the apparatus main body 170. Similarly to the development separation control unit 195R, the development separation control unit 195L has four separation control members (force applying members) 196L corresponding to the process cartridges 100 (100Y, 100M, 100C, and 100K). The four separation control members have substantially the same shape. A fixing plate 195La is always fixed to the image forming apparatus main body. The separation control member 196L is configured to be movable in W41 and W42 directions by a control mechanism (not shown).

Further, the development separation control unit 195 needs to engage with a part of the developing unit 109 in order to control the separation and contact operations of the developing unit 109. For that reason, it is required that a part of the development separation control unit 195 and a part of the developing unit 109 overlap each other in the vertical direction (Z1 and Z2 directions) (see FIG. 10). Accordingly, after the process cartridge 100 is inserted in the X1 direction, in order to overlap in the vertical direction (Z1, Z2 direction) as described above, it is required to cause a part of the developing unit 109 (the moving members 152L and 152R in the case of the present example) to protrude in the Z2 direction. In addition, in a case in which the entire development separation control unit 195 is raised in the same manner as the intermediate transfer unit 12 described above in order to be engaged, there are problems such as an increase in operating force of the interlocking front door 11 and a complicated drive train. In the present example, one of the reasons for adopting a method in which the development separation control unit 195 is fixed to the apparatus main body 170, and a part of the developing unit 109 (the moving members 152L and 152R) is caused to protrude downward (Z2) in the apparatus main body 170 is to meet this issue. Further, as a mechanism for causing the moving members 152L and 152R to protrude, the mechanisms of the storage element pressing unit 190 and the cartridge pressing unit 191 described above are used as they are, and thus there is no problem as described above, and an increase in the cost of the apparatus main body can be inhibited.

Also, the entire unit of the development separation control unit 195 is fixed to the apparatus main body 170. On the other hand, a part of the development separation control unit 195 has a movable configuration in order to execute an operation in which the developing unit 109 engages with the moving members 152L and 152R to be in a separated state (a separated position or a retracted position) and an abutted state (an abutted position) with respect to the photosensitive drum 104.

As described above, although the detailed description has been omitted, the development separation control unit is configured to abut and separate the developing roller 106 and the photosensitive drum 104 with and from each other by acting on the moving members 152L and 152R of the developing unit 109.

Overall Configuration of Process Cartridge

A configuration of the process cartridge will be described with reference to FIGS. 3, 13, and 14. FIG. 13 is an exploded perspective view of the process cartridge 100 from the driving side, which is one end side in an axial direction of the photosensitive drum 104. FIG. 14 is a perspective view of the process cartridge 100 from the driving side.

In the present example, the first to fourth process cartridges 100 (100Y, 100M, 100C, and 100K) may differ in a color of stored toner, a filling amount of toner, and control performed by the apparatus main body 170. However, these four process cartridges have the same basic structure and functions to be fulfilled, although there may be differences in dimensions and the like. For this reason, one process cartridge 100 will be described as a representative below.

The process cartridge 100 includes the photosensitive drum (the photosensitive member) 104, and process unit that act on the photosensitive drum 104. Here, as the process unit, there are the charging roller 105 serving as a charging portion (a charging member) for charging the photosensitive drum 104, the developing roller 106 serving as a developing portion (a developing member) for causing toner to adhere to the photosensitive drum 104 to develop a latent image formed on the photosensitive drum 104, and the like. The developing roller 106 carries toner on its surface. Also, as a further process portion, the process cartridge 100 may include a cleaning blade, a brush, or the like that abuts the photosensitive drum 104, which serves as a cleaning portion (a cleaning member) for removing residual toner on the surface of the photosensitive drum 104. Further, as a further process unit, it may include light guide members such as a light guide and a lens, a light source, and the like for irradiating the photosensitive drum 104 with light, which serve as a static eliminating unit for eliminating static electricity on the surface of the photosensitive drum 104. In addition, the process cartridge 100 is divided into the drum unit (a first unit) 108 (108Y, 108M, 108C, and 108K), and the developing unit (a second unit) 109 (109Y, 109M, 109C, and 109K).

Configuration of Drum Unit

Figure 13:
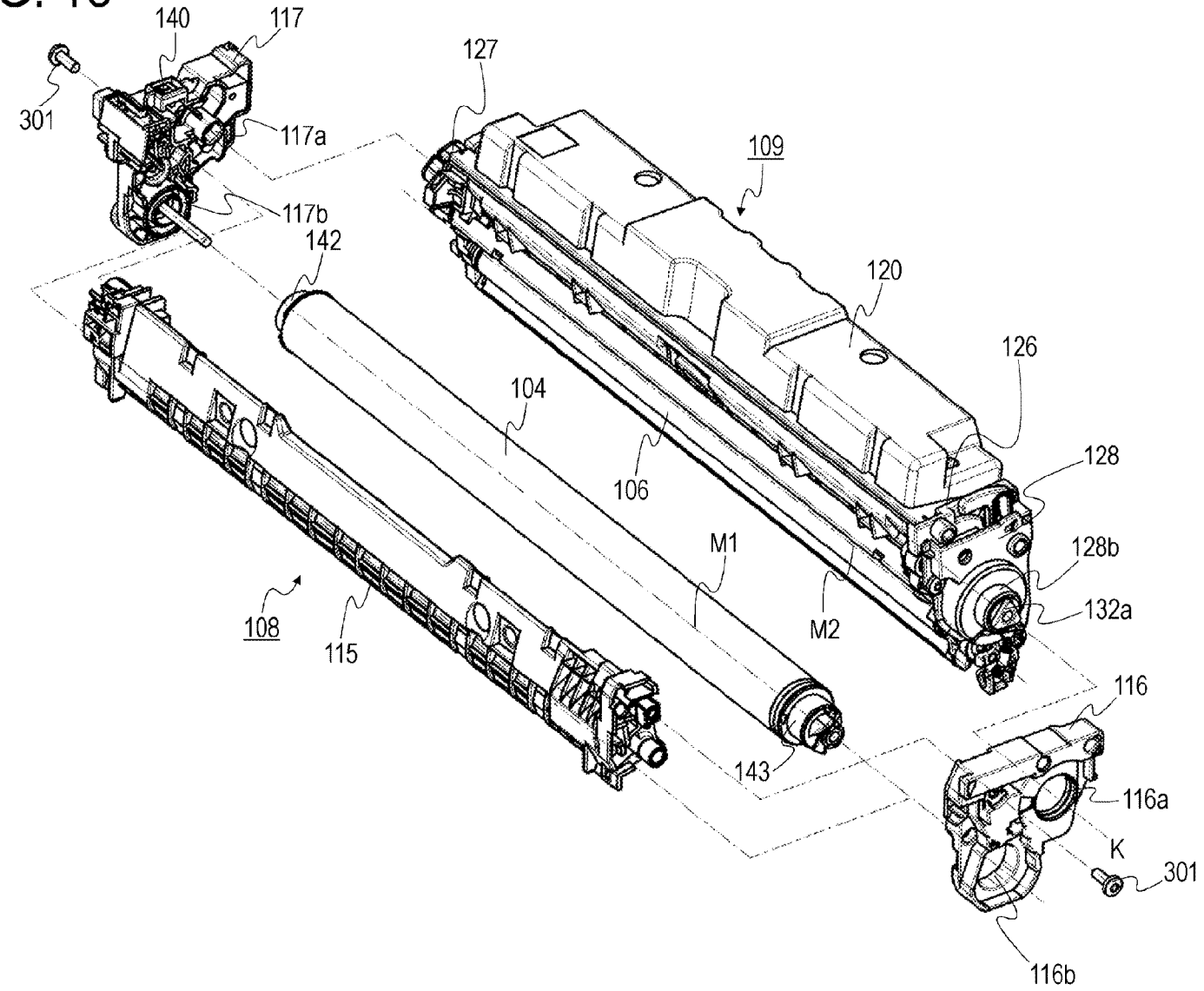
FIG. 13 is an exploded perspective view of the process cartridge of Example 1.
Figure 14:
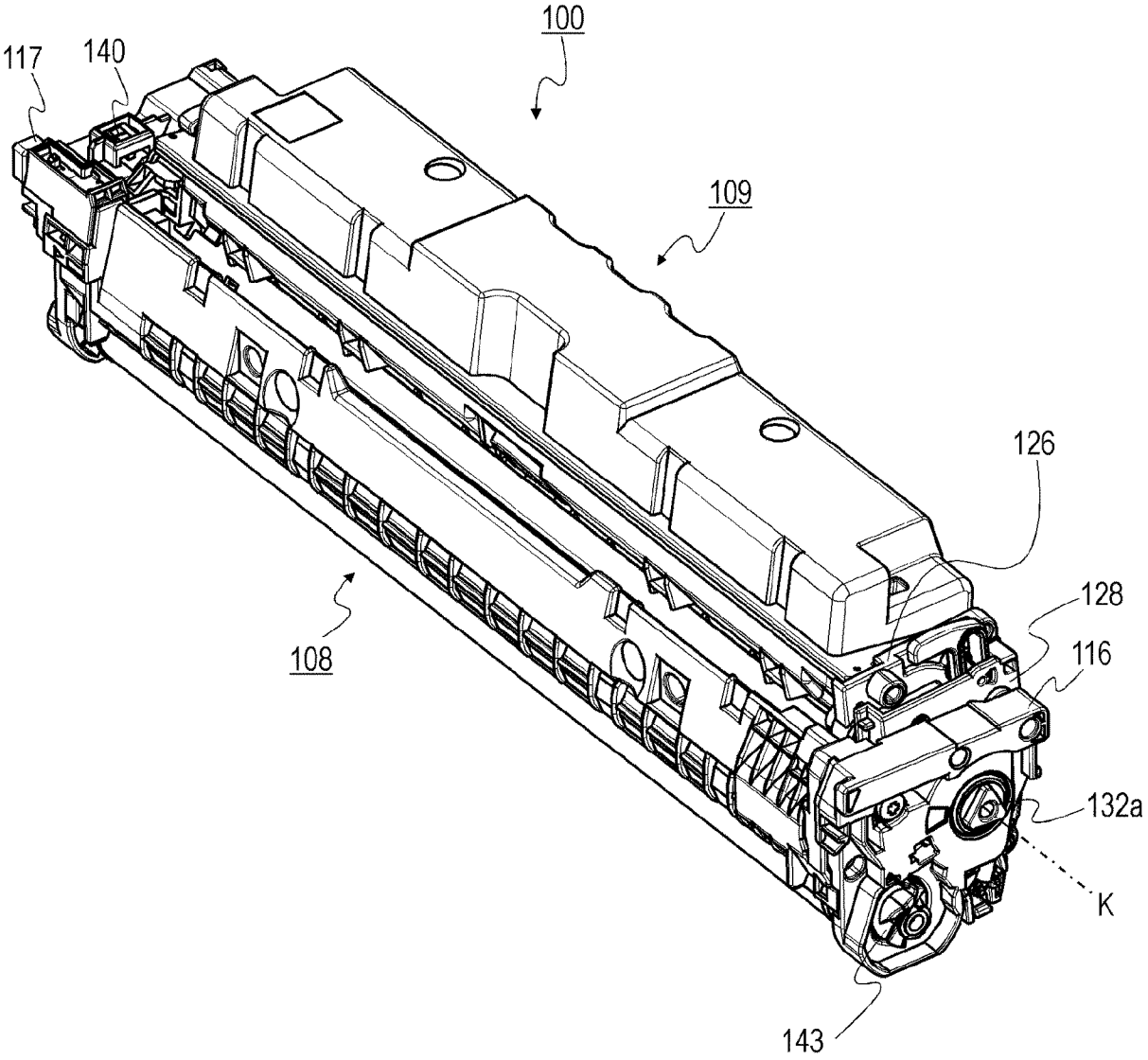
FIG. 14 is a perspective view of the process cartridge of Example 1.

As shown in FIGS. 3 and 13, the drum unit 108 includes the photosensitive drum 104, the charging roller 105, and a first drum frame body portion 115. In addition, the drum unit 108 has the driving side cartridge cover member 116 and the non-driving side cartridge cover member 117, which serve as a second drum frame body portion attached and fixed to the first drum frame body portion 115. The photosensitive drum 104 is rotatably supported around a rotation axis (a rotation center) M1 by the driving side cartridge cover member 116 and the non-driving side cartridge cover member 117 disposed at both ends in the longitudinal direction of the process cartridge 100. The first drum frame body portion 115, and the driving side cartridge cover member 116 and the non-driving side cartridge cover member 117 serving as the second drum frame body portion constitute a drum frame body (a first frame body or a photosensitive member frame body) that rotatably supports the photosensitive drum 104. The driving side cartridge cover member 116 and the non-driving side cartridge cover member 117 will be described later.

As shown in FIGS. 13 and 14, the coupling member 143 for transmitting a driving force to the photosensitive drum 104 is provided on one end side of the photosensitive drum 104 in the longitudinal direction. As described above, the coupling member 143 engages with the main body side drum drive coupling 180 (see FIGS. 9A and 9B) serving as a drum drive output portion of the apparatus main body 170. Then, a driving force of a drive motor (not shown) of the apparatus main body 170 is transmitted to the photosensitive drum 104, which is rotated in the direction of arrow A (see FIG. 3). Further, the photosensitive drum 104 has a drum flange 142 on the other end side in the longitudinal direction. The charging roller 105 is supported by the drum frame body 115 so that it can come into contact with the photosensitive drum 104 and rotate in a driven manner. Also, the rotation axis M1 is parallel to the longitudinal direction of the process cartridge 100 and the longitudinal direction of the drum unit 108.

Configuration of Developing Unit

As shown in FIGS. 3 and 13, the developing unit 109 is configured of the developing roller 106, a toner conveying roller (a developer feed member) 107, a developing blade 130, a developer container 120, and the like. The developer container 120 that constitutes a frame body of the developing unit is configured of a developing frame body 121 and a lid member 122. The developing frame body 121 and the lid member 122 are joined by ultrasonic welding or the like. The developer container 120 has a toner storage portion (a toner storage chamber) 129 for storing toner fed to the developing roller 106, and a developing space 123 serving as a space for feeding toner to the developing roller 106 in which the toner conveying roller 107 is disposed. In the developer container 120, a driving side bearing 126 and a non-driving side bearing 127 serving as bearing members are attached and fixed to both ends in the longitudinal direction of the developing frame body 121 disposed along the longitudinal direction of the developing roller 106 with respect to the developing roller 106. In addition, the developer container 120 rotatably supports the developing roller 106, the toner conveying roller 107, and a stirring member 129*a* (see FIG. 3) via the driving side bearing 126 and the non-driving side bearing 127, and holds the developing blade 130. In this way, the developer container 120, the driving side bearing 126, and the non-driving side bearing 127 constitute a developing frame body (a second frame body) that rotatably supports the developing roller 106 around a rotation axis (a rotation center) M2.

The stirring member 129*a* rotates to stir the toner in the toner storage unit 129. The toner conveying roller (the developer feed member) 107 comes into contact with the developing roller 106, feeds the toner to the surface of the developing roller 106, and also performs stripping of the toner from the surface of the developing roller 106. The developing blade 130 is formed by attaching an elastic member 130*b*, which is a sheet-like metal having a thickness of about 0.1 mm, to a support member 130*a*, which is a metal material having an L-shaped cross-section, by welding or the like. As a regulating member, the developing blade 130 regulates a layer thickness of the toner (a thickness of a toner layer) on a circumferential surface of the developing roller 106 and forms the toner layer having a predetermined thickness between the elastic member 130*b* and the developing roller 106. The developing blade 130 is attached to the developer container 120 with fixing screws 118 at two locations on one end side and the other end side in the longitudinal direction. The developing roller 106 is configured of a core metal 106*c* made of a metal material and a rubber portion 106*d*.

As shown in FIGS. 13 and 14, the developing coupling portion 132*a* for transmitting a driving force to the developing unit 109 is provided on one end side of the developing unit 109 in the longitudinal direction. The developing coupling portion 132*a* is a member that engages with the main body side developing drive coupling 185 (see FIGS. 9A and 9B) serving as a developing drive output portion of the apparatus main body 170 and receives a rotational driving force of the drive motor (not shown) of the apparatus main body 170 to rotate. The driving force received by the developing coupling portion 132*a* is transmitted by a drive train (not shown) provided in the developing unit 109, so that the developing roller 106 can be rotated in a direction of arrow D in FIG. 3. A developing cover member 128 that supports and covers the developing coupling portion 132*a* and a drive train (not shown) is provided on one end side of the developing unit 109 in the longitudinal direction. Also, an outer diameter of the developing roller 106 is set to be smaller than an outer diameter of the photosensitive drum 104. The outer diameter of the photosensitive drum 104 of the present example is set in the range of Φ18 to Φ22, and the outer diameter of the developing roller 106 is set in the range of Φ8 to Φ14. By setting this outer diameter, it is possible to perform efficient arrangement. However, the outer diameters of the photosensitive drum 104 and the developing roller 106 are not limited to the above ranges. In addition, the rotation axis M2 is parallel to the longitudinal direction of the process cartridge 100 and the longitudinal direction of the developing unit 109.

Assembly of Drum Unit and Developing Unit

Assembly of the drum unit 108 and the developing unit 109 will be described with reference to FIG. 13. The drum unit 108 and the developing unit 109 are joined together by the driving side cartridge cover member 116 and the non-driving side cartridge cover member 117 provided at both ends of the process cartridge 100 in the longitudinal direction. The driving side cartridge cover member 116 is provided on one end side of the process cartridge 100 in the longitudinal direction. The driving side cartridge cover member 116 is provided with a developing unit support hole 116*a* for supporting the developing unit 109 to be swingable (movable). The non-driving side cartridge cover member 117 is provided on the other end side of the process cartridge 100 in the longitudinal direction. The non-driving side cartridge cover member 117 is provided with a developing unit support hole 117*a* for supporting the developing unit 109 to be swingable. Further, the driving side cartridge cover member 116 and the non-driving side cartridge cover member 117 are provided with drum support holes 116*b* and 117*b* for supporting the photosensitive drum 104 to be rotatable.

Here, an outer diameter portion of a cylindrical portion 128*b* of the developing cover member 128 is fitted into the developing unit support hole 116*a* of the driving side cartridge cover member 116 on one end side of the process cartridge 100 in the longitudinal direction. An outer diameter portion of a cylindrical portion (not shown) of the non-driving side bearing 127 is fitted into the developing unit support hole 117*a* of the non-driving side cartridge cover member 117 on the other end side of the process cartridge 100 in the longitudinal direction. Further, both ends of the photosensitive drum 104 in the longitudinal direction are fitted into the drum support hole 116*b* of the driving side cartridge cover member 116 and the drum support hole 117*b* of the non-driving side cartridge cover member 117. Then, the driving side cartridge cover member 116 and the non-driving side cartridge cover member 117 are fixed to the drum unit 108 by screws 118. Also, a fixing method may be adhesives or the like instead of screws. Thus, the developing unit 109 is movably supported by the driving side cartridge cover member 116 and the non-driving side cartridge cover member 117 with respect to the drum unit 108 (the photosensitive drum 104). In such a configuration, the developing roller 106 can be positioned at a position that acts on the photosensitive drum 104 during image formation.

FIG. 14 shows a state in which the drum unit 108 and the developing unit 109 are assembled by the above steps and integrated as the process cartridge 100. Also, an axis connecting a center of the developing unit support hole 116*a* of the driving side cartridge cover member 116 and a center of the developing unit support hole 117*a* of the non-driving side cartridge cover member 117 is referred to as a swing axis (a rotation axis or a rotation center) K (see FIGS. 13 and 14). Here, the cylindrical portion 128*b* of the developing cover member 128 on one end side of the process cartridge 100 in the longitudinal direction is coaxial with the developing coupling portion 132*a*. That is, the rotation axis of the developing coupling portion 132*a* is coaxial with the swing axis K. In addition, the developing unit 109 is rotatably supported around the swing axis K. In a state in which the drum unit 108 and the developing unit 109 are assembled and integrated as the process cartridge 100, the rotation axis M1, the rotation axis M2, and the swing axis K are substantially parallel to each other. Further, in this state, the rotation axis M1, the rotation axis M2, and the swing axis K are substantially parallel to the longitudinal direction of the process cartridge 100 as well.

Fixing Method of Developing Unit

Figure 15:
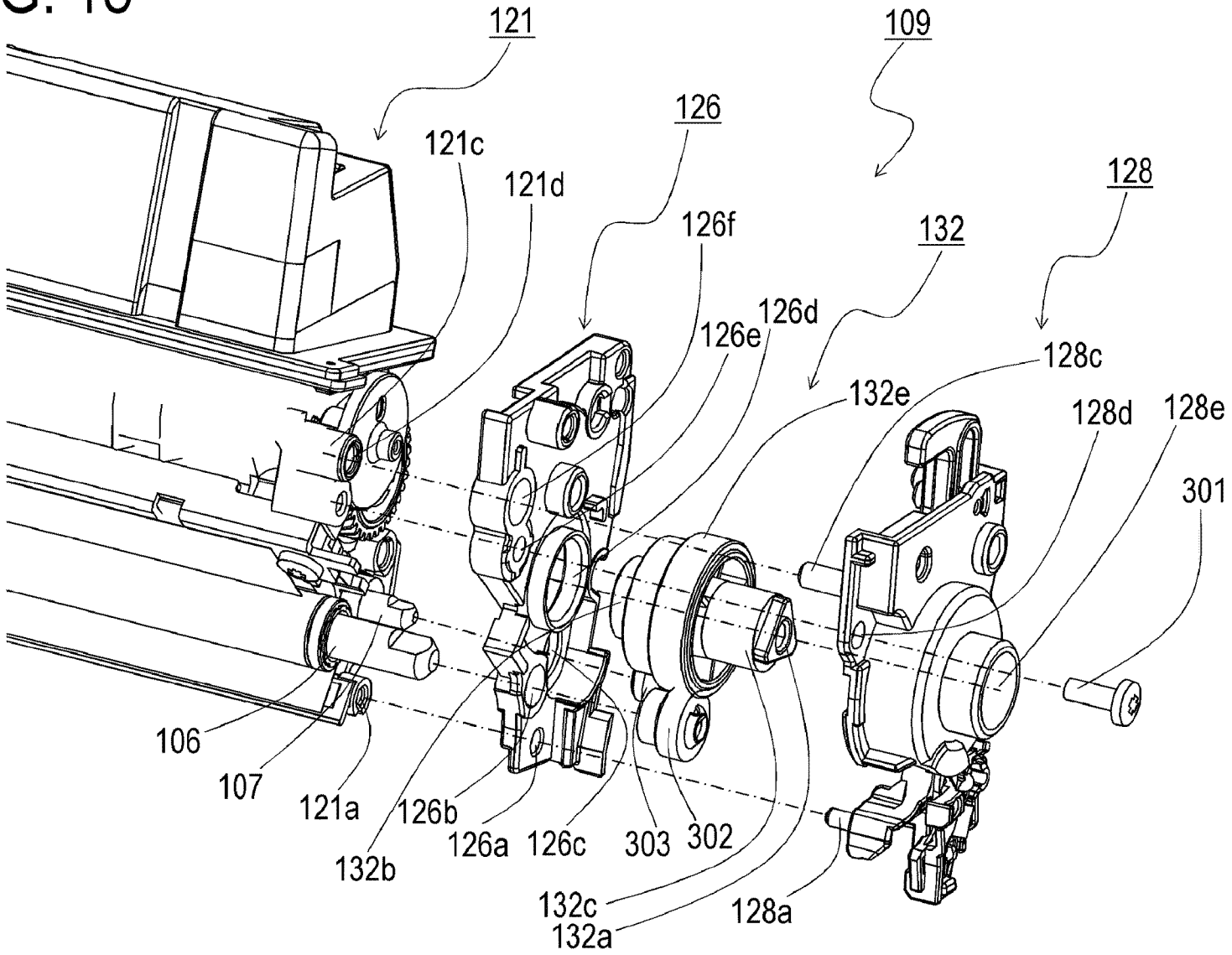
FIG. 15 is an exploded perspective view of the developing unit of Example 1.
Figure 16:
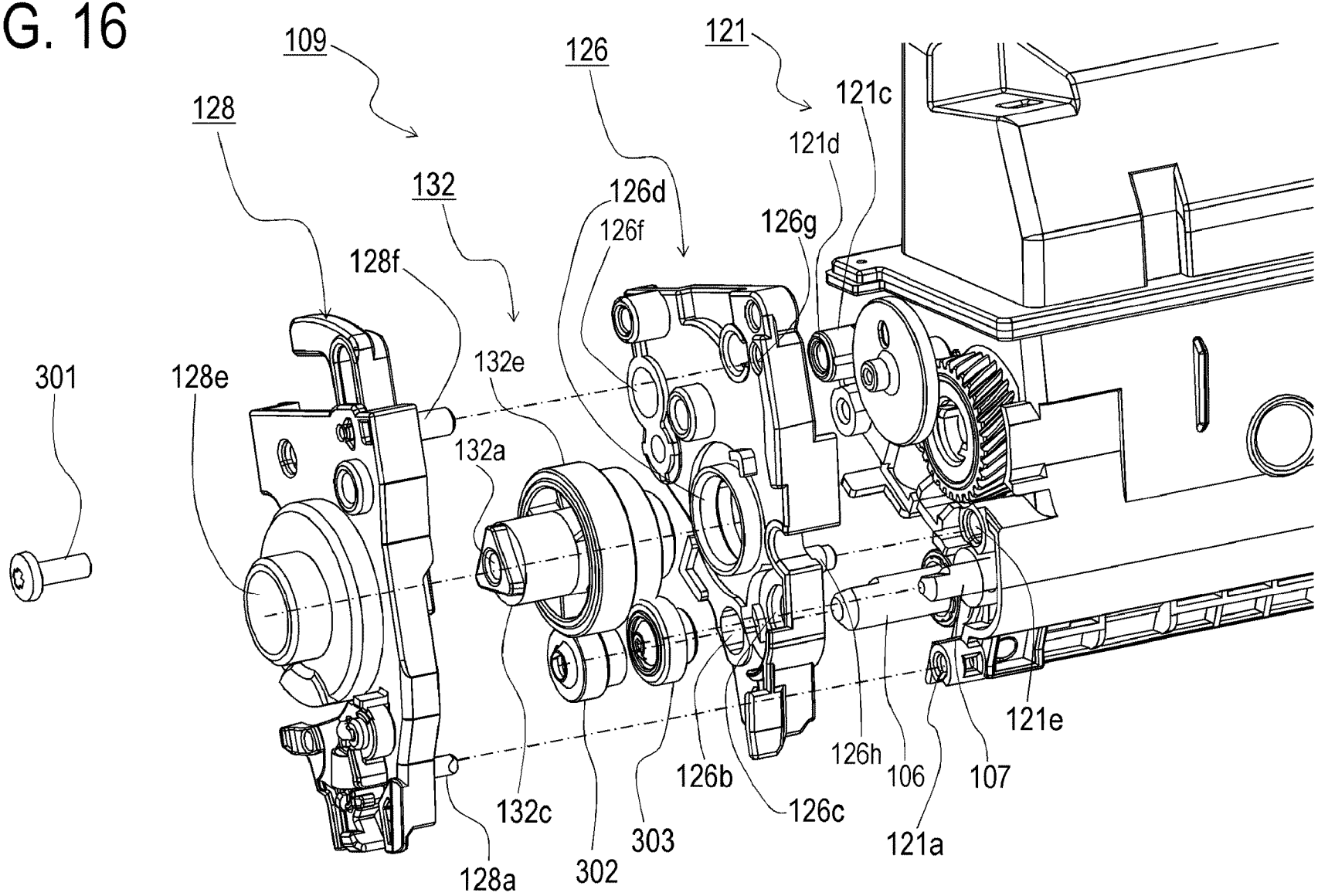
FIG. 16 is an exploded perspective view of the developing unit of Example 1.

With reference to FIGS. 15 and 16, the developing unit 109 that fixes various components serving as constituent members by using a terpene-based solvent (hereinafter referred to as limonene), which is a feature of the present example, will be described. FIG. 15 is an exploded perspective view showing a configuration of the driving side, which is one end side of the developing unit 109 in the longitudinal direction, in an exploded manner and is a diagram when the developing unit 109 is viewed from a side on which the drum unit 108 is disposed with respect to the developing unit 109. FIG. 16 is an exploded perspective view showing a configuration of the driving side of the developing unit 109 in an exploded manner and is a diagram showing a configuration of the developing unit 109 on a side opposite to the side shown in FIG. 15.

Also, a fixing method in a joining configuration of the developing unit 109 on the driving side will be described here, but a joining configuration thereof on the non-driving side is also configured in the same manner, and the description thereof will be omitted.

A developing drive force receiving gear 132, a developing gear 302, and a toner conveying gear 303 are disposed on the driving side of the developing unit 109, which transmit a driving force for conveying toner and rotating rollers, which will be described later. In addition, for a material constituting a sliding support portion that rotatably supports the developing roller 106, the toner conveying roller 107, and the like in the developing unit 109, a material having higher (good) slidability than a material used for the developing frame body 121 is used in order to reduce sliding resistance with the rollers. Generally, for example, a polyacetal resin is used for a material having higher (good) slidability than a styrene-based resin typified by high impact polystyrene (HIPS) used for the developing frame body 121. With this configuration, the developing roller 106 and the toner conveying roller 107 are also held by the driving side bearing 126 made of polyacetal. Specifically, the developing roller 106 is rotatably held in a driving side bearing hole 126*b*, and the toner conveying roller 107 is rotatably held in a driving side bearing hole 126*c*.

Further, a position of the driving side bearing 126 with respect to the developing frame body 121 is determined by engagement of the developing frame body boss 121*c* and a driving side bearing hole 126*f*, and the developing frame body hole 121*e* and a driving side bearing boss 126*h* (FIG. 16). The developing gear 302 engages with the developing roller 106, and the toner conveying gear 303 engages with the toner conveying roller 107. The developing gear 302 and the toner conveying gear 303 are connected to the developing drive force receiving gear 132 via gear tooth surfaces (not shown). A gear train configured of these plurality of gears is covered with the developing cover member 128.

The developing drive force receiving gear 132 (a drive force receiving member) has a gear portion 132*e* having a gear tooth surface that engages with the developing gear 302, a support portion 132*b* (FIG. 15), which is an end portion located inward from the gear portion 132*e* in the longitudinal direction, and a support portion 132*c*, which is an end portion located outward from the gear portion in the longitudinal direction. The developing coupling portion 132*a* is provided on a longitudinal end face of the support portion 132*c* serving as a drive force receiving portion. One and the other end portions of the developing drive force receiving gear 132 in a rotation axis direction of the gear portion 132*e* are supported by the driving side bearing 126 and the developing cover member 128. Specifically, in the developing drive force receiving gear 132, the support portion 132*b* is rotatably held in the driving side bearing hole 126*d*, and the support portion 132*c* is rotatably held in the developing cover member hole 128*e*. Further, the developing frame body hole 121*d* and the developing cover member boss 128*c*, and the driving side bearing hole 126*g* and the developing cover member boss 128*f* (FIG. 16) are respectively engaged with each other, and thus a position of the developing cover member 128 is determined with respect to the developing frame body 121 and the driving side bearing 126 fixed thereto. That is, the developing cover member 128 is attached to an end portion of the developing frame body 121 to sandwich the driving side bearing 126 with the end portion of the developing frame body 121 in the axis direction of the developing roller 106. In addition, the driving side bearing 126 and the developing cover member 128 are fixed to the developing frame body 121 by a screw 301 and bonding using limonene, which is a feature of the present example.

Figure 1:
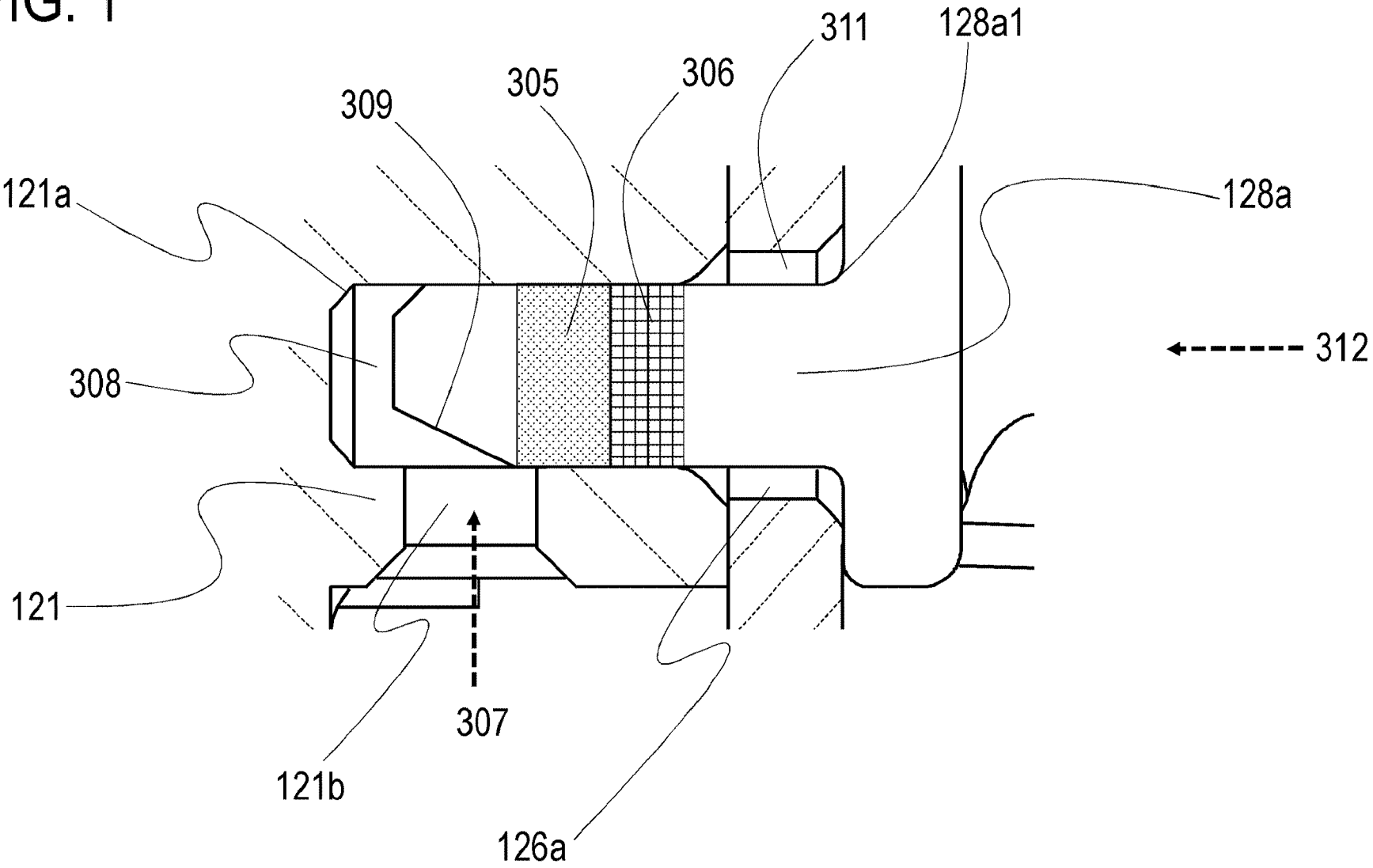
FIG. 1 is an enlarged cross-sectional view of a developing unit of Example 1.
Figure 17:
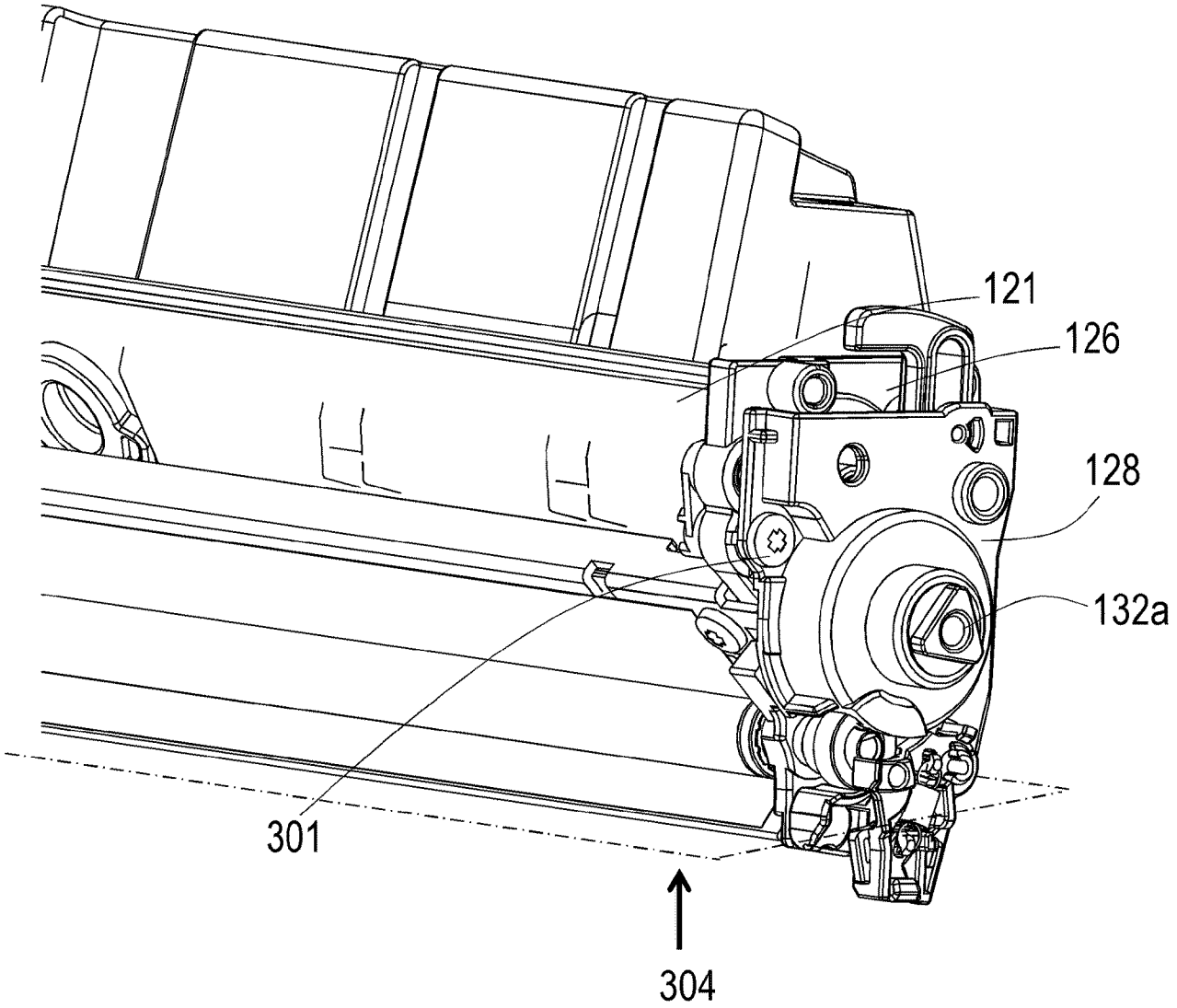
FIG. 17 is a perspective view of the developing unit of Example 1.
Figure 18:
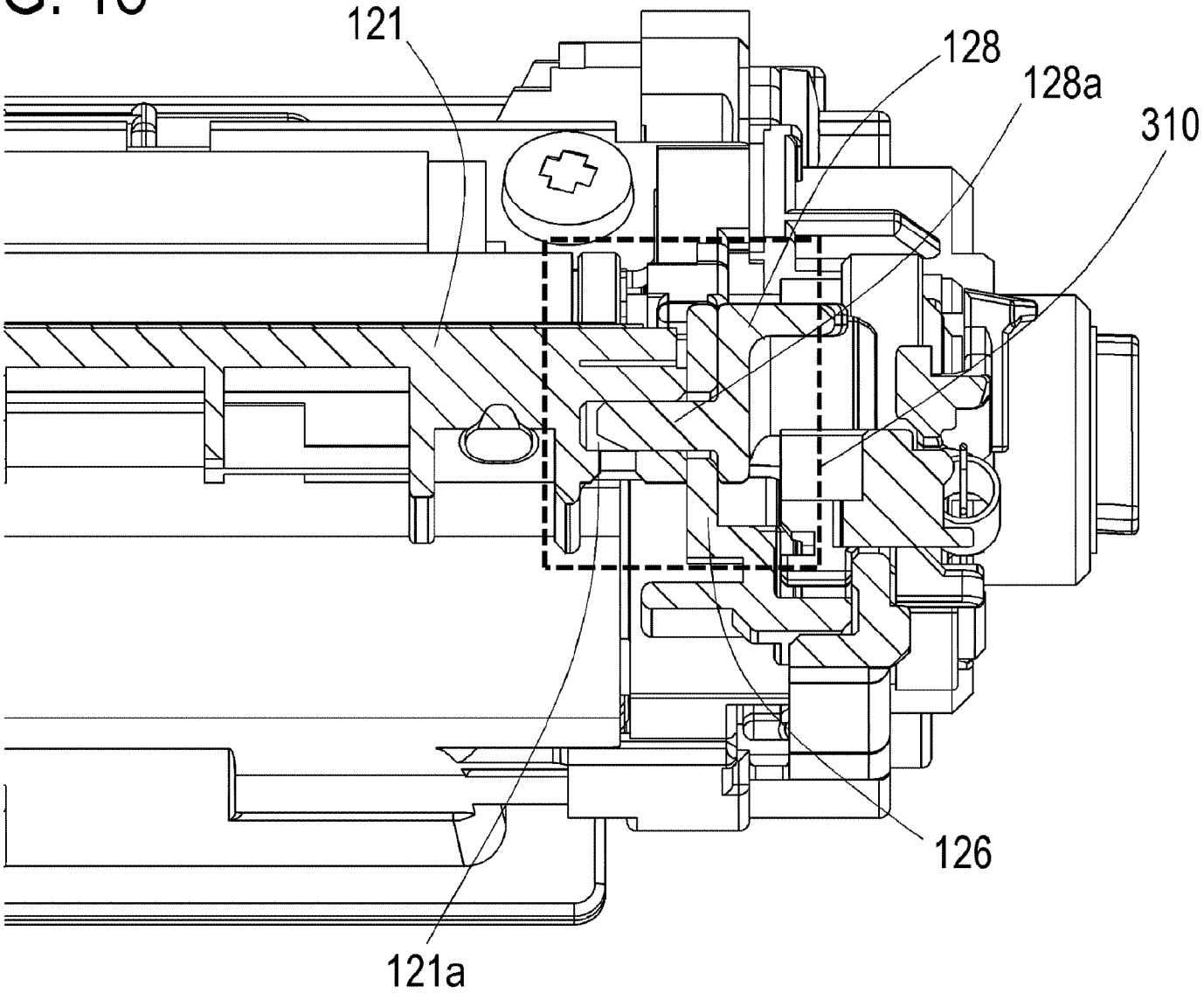
FIG. 18 is a cross-sectional view of the developing unit of Example 1.
Figure 19:
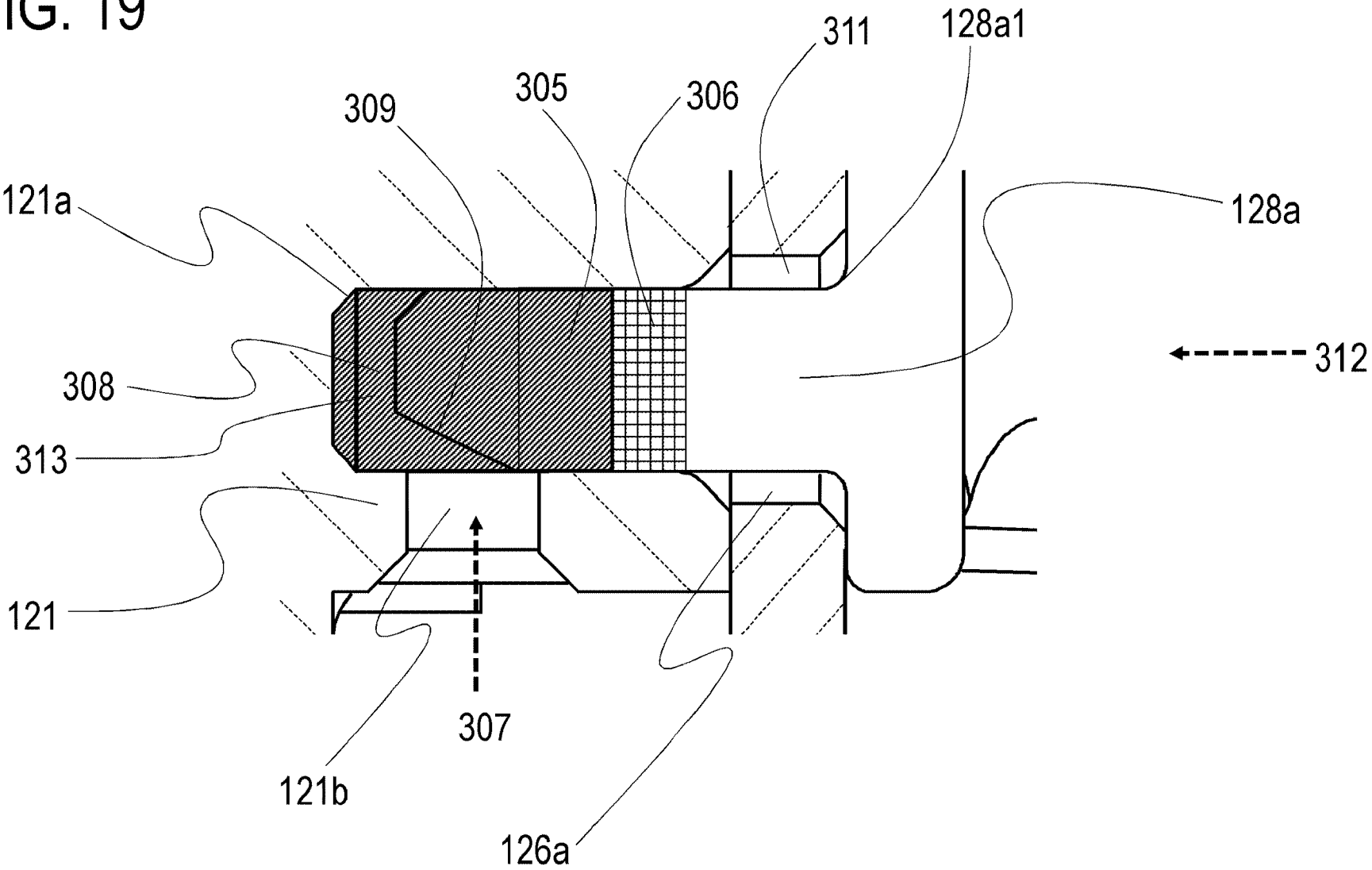
FIG. 19 is an enlarged cross-sectional view of the developing unit of Example 1.

A bonding method using limonene serving as an adhesive will be described with reference to FIGS. 1, 17, 18, and 19. FIG. 17 is a perspective view showing a configuration of the driving side of the developing unit 109. FIG. 18 is a schematic cross-sectional view of a cross-section surrounded by the alternate long and short dash line in FIG. 17 in a direction of arrow 304. The cross-sectional line in the cross-sectional view is centered on the developing frame body hole 121*a* and the developing cover member boss 128*a*, which are subjected to the bonding using limonene, which is a feature of the present example. Further, an enlarged view of the region 310 in FIG. 18 is shown in FIG. 1. FIG. 1 is a schematic cross-sectional view showing a state in which the developing cover member boss 128*a* engages with the developing frame body hole 121*a*. FIG. 19 is a schematic cross-sectional view showing a state in which the developing cover member boss 128*a* engages with the developing frame body hole 121*a* and an adhesive portion 313 is formed.

A method for assembling (a method for manufacturing) the developing unit 109 of the present example roughly includes an assembling process of attaching constituent members of the developing unit 109 to each other, and a bonding process of injecting limonene serving as an adhesive from the outside into joining portions between the constituent members to cause them to bond together (forming the adhesive portion 313).

As shown in FIGS. 15 and 16, the developing frame body 121 has the developing frame body hole 121*a* serving as a hole portion depressed in the longitudinal direction on a surface facing the driving side bearing 126 in the longitudinal direction (the axis direction of the developing roller 106). Further, the driving side bearing 126 has a driving side bearing hole 126*a* serving as a through hole penetrating in the longitudinal direction at a position corresponding to the developing frame body hole 121*a*. The developing cover member 128 serving as an end portion member has the developing cover member boss 128*a* serving as a protruding portion inserted in the longitudinal direction into the developing frame body hole 121*a* via the driving side bearing hole 126*a*. That is, a portion of the developing cover member boss 128*a* that penetrates the driving side bearing hole 126*a* toward a side of the developing frame body 121 is inserted into the developing frame body hole 121*a*. The driving side bearing 126 is sandwiched between the developing frame body hole 121*a* and the developing cover member boss 128*a*, but as shown in FIG. 1, there is a certain gap (a space 311) between the driving side bearing hole 126*a* and the developing cover member boss 128*a*.

Further, an area between the developing frame body hole 121*a* and the developing cover member boss 128*a* inserted therein is divided into an area 305 (a second area, a second region) formed in a fit-in relationship, and an area 306 (a first area, a first region) formed in a press-in relationship. In addition, the area 306 is disposed on a side close to a base portion 128*a*1 of the developing cover member boss 128*a*. The area 305 is provided at a portion closer to a tip of the developing cover member boss 128*a* than the area 306. That is, the developing cover member boss 128*a* has the area 306 that is press-fitted into an inner wall surface (an inner peripheral surface) thereof along a longitudinal direction of the driving side bearing hole 126*a*, and the area 305 facing the inner wall surface with a gap therebetween at a position further toward a boss tip side from the area 306. The gap is formed between an outer peripheral surface of the developing cover member boss 128*a* and the inner peripheral surface of the developing frame body hole 121*a*.

In the developing frame body 121, the developing frame body hole 121*b*, which is a through hole for injecting limonene, is open in a direction perpendicular to a direction 312 in which the developing frame body hole 121*a* and the developing cover member boss 128*a* are fitted to each other.

The developing frame body hole 121*b* is a communication hole that penetrates the developing frame body 121 in a direction intersecting the axis direction of the developing roller 106 to connect an inside of the developing frame body hole 121*a* to an outside of the developing frame body 121. The developing frame body hole 121*b* is open to at least partially overlap an area facing the area 305 on the inner wall surface of the developing frame body hole 121*a* when viewed in a direction orthogonal to the axis direction. Further, in the developing frame body hole 121*b*, an opening portion that is open toward the inside of the developing frame body hole 121*a* is open to overlap a tip portion of the developing cover member boss 128*a* at a position further toward a tip side from the area 305 when viewed in the direction orthogonal to the above axis direction.

As described above, the developing frame body hole 121*b* and the area 305 overlap each other in the longitudinal direction. Accordingly, when limonene is injected in a direction of arrow 307, which is parallel to the developing frame body hole 121*b*, the limonene enters the gap between the inner peripheral surface of the developing frame body hole 121*a* in the area 305 and the outer peripheral surface of the developing cover member boss 128*a*, which are in the fit-in relationship, due to the capillary phenomenon. An amount of the gap in the area 305, that is, a difference between an inner diameter of the developing frame body hole 121*a* and an outer diameter of the developing cover member boss 128*a* is, for example, 2 μm to 27 μm in diameter. Thus, the limonene spreads over the entire area 305. As a result, the developing frame body hole 121*a* of the developing frame body 121 made of high impact polystyrene (HIPS), which is a styrene-based resin composition, and a part of the developing cover member boss 128*a* of the developing cover member 128 melt and bond together.

That is, the area 305 is a region in which the developing frame body hole 121*a* and the developing cover member boss 128*a* are fitted to each other due to a so-called clearance fit. The amount of the gap between the developing frame body hole 121*a* and the developing cover member boss 128*a* in the area 305 is preferably set to allow the limonene injected from the developing frame body hole 121*b* to enter the gap of the area 305 due to the capillary phenomenon and is not limited to a specific value. That is, a dimensional relationship of the area 305 may be arbitrarily set in accordance with a configuration of the apparatus, and the above-mentioned numerical range is merely an example.

On the other hand, the area 306 that is in the press-in relationship is a region that fits in a so-called interference fit relationship, for example, has a tightening margin with the inner diameter of the inner wall surface of the developing frame body hole 121*a* in a press-in region, and has a dimensional relationship such that a gap for the capillary phenomenon is not formed. That is, the developing frame body hole 121*a* and the developing cover member boss 128*a* are in close contact with each other in the area 306 not to allow the limonene injected from the developing frame body hole 121*b* and filled in the area 305 due to the capillary phenomenon to further enter the area 306. In this way, the limonene does not flow into the area 306 because there is no gap for the capillary phenomenon to work. Accordingly, the limonene does not flow into the driving side bearing 126 side made of polyacetal.

Thus, according to the present example, since it is not required to provide a limonene injection port on an inner diameter side of a boss as in a configuration described in Japanese Patent Application Laid-open No. 2005-250310, a diameter of the boss can be reduced, which can contribute to reduction in size of a unit. In addition, since it is also not required to create a large space in which the capillary phenomenon does not occur in order to stop the capillary phenomenon, it is possible to perform limonene bonding in a small space. Further, the press-in portion makes it possible to stop a flow of limonene, and it is possible to prevent limonene from flowing into components not melted with limonene, such as polyacetal, which are disposed before the press-in portion.

In addition, a space 308 is formed between the tip portion of the developing cover member boss 128*a* and a base (a bottom portion) of the developing frame body hole 121*a*, at least a part of the space 308 is formed between the outer peripheral surface of the tip portion of the developing cover member boss 128*a* and the inner peripheral surface of the developing frame body hole 121*a*, and an inclined surface (a tapered surface) 309 is provided at the tip portion of the developing cover member boss 128*a*. In more detail, the inclined surface 309 is positioned at a position closer to the tip of the developing cover member boss 128*a* than the area 305. In the developing frame body hole 121*b*, the opening portion, which opens toward an inside of the developing frame body hole 121*a*, opens to overlap the tip portion of the developing cover member boss 128*a* at a position further toward a tip side from the area 305 when viewed in the direction orthogonal to the axis direction. The inclined surface 309 at the tip of the developing cover member boss 128*a* is inclined to be further separated from the opening portion toward the tip of the developing cover member boss 128*a* in the region facing the opening portion of the developing frame body hole 121*b* at the tip portion of the developing cover member boss 128*a*. Thus, limonene applied to the inclined surface 309 via the developing frame body hole 121*b* can enter the space 308 through the inclined surface 309. When limonene is applied, an amount of limonene applied tends to vary slightly, but since excessive limonene flows into the space 308 through the inclined surface 309, it is possible to inhibit overflow of limonene from the developing frame body hole 121*b* to the outside. Also, structures for which the same effects can be obtained are not limited to the inclined surface structure in which a part of the tip portion of the boss 128*a* is partially cut out due to the inclined surface 309 described above.

Figure 20:
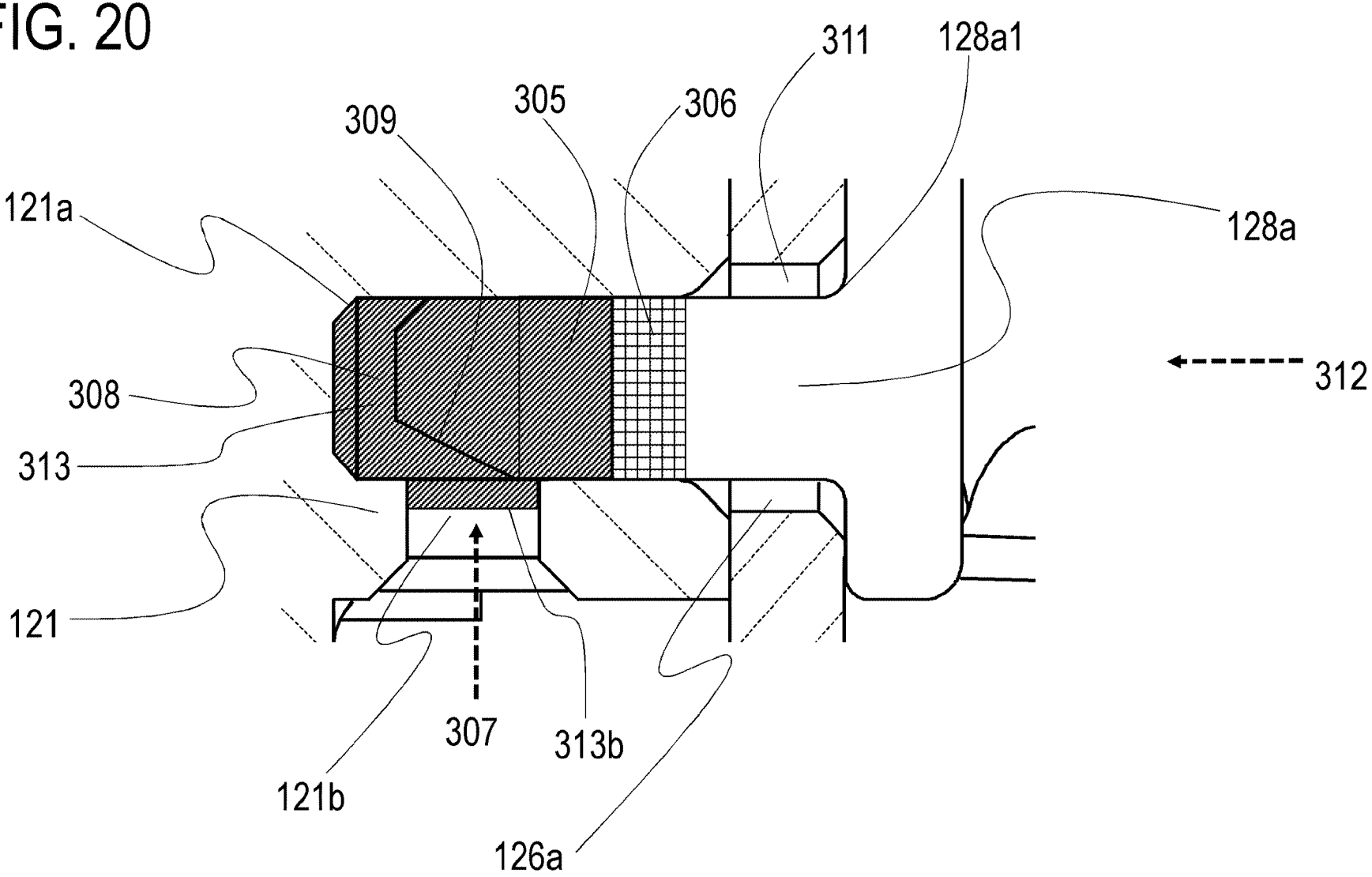
FIG. 20 is an enlarged cross-sectional view of the developing unit of Example 1.

As shown in FIG. 19, by applying the above-mentioned limonene, the adhesive portion 313 for bonding the developing frame body 121 and the developing cover member 128 is formed between the developing frame body hole 121*a* and the developing cover member boss 128*a*. The adhesive portion 313 has at least a portion filled in the gap between the area 305 of the developing cover member boss 128*a* and the facing region of the inner wall surface of the developing frame body hole 121*a*. Depending on the amount of limonene applied, the adhesive portion 313 includes a portion that fills the space 308 between the tip portion of the developing cover member boss 128*a* and the bottom portion of the developing frame body hole 121*a*. In addition, depending on the amount of limonene applied, the adhesive portion 313 may include a portion 313*b* that is filled to protrude into at least a part of the developing frame body hole 121*b*, as shown in FIG. 20.

As described above, the present example has adopted the configuration in which a fit-in region between the boss and the hole for positioning and bonding components is divided into the press-in portion (a first region) and the fitting portion (a second region) in a small cartridge with little space for bonding components together. In addition, an injection port of limonene is provided on the side close to the fitting portion in the direction perpendicular to the axis direction of the boss and the hole, and the limonene is caused to flow from the injection port communicating with the fitting portion to form the adhesive portion. Thus, even in a case in which a space of a joining portion is small, high strength adhesive joining becomes possible. Further, since limonene does not flow beyond the press-in portion, it is possible to dispose components such as polyacetal (hereinafter, POM components) not melted with limonene before the press-in portion. For example, if there is no press-in portion and POM components or the like are disposed in a place into which limonene flows, only components melted with limonene melt, which decreases the strength. That is, in a case in which components melt together, they melt together and become one, which does not decrease the strength, but in a case in which only one of them melts, the strength decreases. Accordingly, as in the present example, by providing the press-in portion and creating the region in which limonene does not flow, the POM components can be easily fixed.

The direction in which the developing frame body hole 121*b* opens does not have to be the direction perpendicular to the direction 312 in which the developing cover member boss 128*a* fits into the developing frame body hole 121*a*. That is, the direction may be a direction having an angle with respect to the perpendicular direction and a direction intersecting the fitting direction 312 as long as limonene can be injected into the area 305. In addition, the extending direction of the hole is also not limited to the configuration in which the hole extends linearly, and a size of the hole does not have to be constant. Further, the number of holes to be provided may be two or more.

In present example, the configuration has been adopted in which the developing cover member 128 serving as one member is provided with the developing cover member boss 128*a* serving as a protruding portion, and this is inserted into the developing frame body hole 121*a* provided in the developing frame body 121, which serves as the other member, but the present invention is not limited to such a configuration. That is, the protruding portion may be provided in the developing frame body 121 serving as one member, and the hole portion into which the protruding portion is inserted may be provided in the developing cover member 128 serving as the other member.

In the present example, the configuration has been adopted in which the driving side bearing 126 has the driving side bearing hole 126*a* serving as a through hole, but the present invention is not limited to the configuration. For example, a configuration in which a slit is provided instead of the through hole, or a configuration in which a relief portion having a shape of escaping from the region in which the developing cover member boss 128*a* extends may be adopted.

In the present example, the configuration has been adopted in which the developing frame body hole 121*b* is open to at least partially overlap the facing region of the area 305 when viewed in the direction orthogonal to the axis direction, but a configuration in which they do not overlap each other may be adopted. That is, it may be sufficient that the developing frame body hole 121*b* communicates with the gap of the area 305 so that limonene can be injected into the area 305 through the developing frame body hole 121*b*.

In the present example, the example has been described in which the above-mentioned adhesive structure using limonene is applied to the joining portion between the constituent members in the developing unit 109, but the configuration to which the present invention can be applied is not limited to the developing unit 109. A similar adhesive structure may be applied to a joining portion between constituent members of the drum unit 108.

In the present example, a terpene-based solvent (limonene) is shown as an adhesive, and a styrene-based resin composition (HIPS) is shown as a material for the frame body or the end portion member serving as a bonding target, and a material (polyacetal) not melted with the terpene-based solvent is shown as a material for the bearing member. These are merely examples, and it is needless to say that, by applying the adhesive structure of the present invention to an adhesively joining portion of an assembly structure configured of a combination of other materials in accordance with compatibility of materials and the like, the same effects as those of the present embodiment can also be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-139199, filed on Aug. 27, 2021, which is hereby incorporated by reference herein in its entirety.

What is claimed is:

1. A developing unit comprising:

a developing roller;

a frame body of which a longitudinal direction is a rotation axis direction of the developing roller;

a bearing member attached to an end portion of the frame body in the rotation axis direction, the bearing member rotatably supporting an end portion of the developing roller in the rotation axis direction; and an end portion member attached to the end portion of the frame body outside the bearing member in the rotation axis direction to sandwich the bearing member together with the frame body;

wherein one of the frame body and the end portion member includes a hole portion that is depressed in the rotation axis direction on a facing surface that faces the bearing member, and the other of the frame body and the end portion member includes a protruding portion that is inserted into the hole portion and extends in the rotation axis direction, the protruding portion includes a first region and a second region that is provided at a position closer to a tip of the protruding portion than the first region is, the first region of the protruding portion being press-fitted into the hole portion, the second region being inserted into the hole portion with a gap between an outer peripheral surface of the protruding portion and an inner peripheral surface of the hole portion, the frame body includes a communication hole that extends in a direction intersecting the rotation axis direction such that the gap leads to an outside of the frame body through the communication hole, and at least a part of the communication hole and the gap are filled with an adhesive.

2. The developing unit according to claim 1, wherein the adhesive contains a terpene-based solvent, and the bearing member is made of a material that does not dissolve in the terpene-based solvent.

3. The developing unit according to claim 1, wherein at least a part of the communication hole overlaps the second region of the protruding portion as viewed in a direction orthogonal to the rotation axis direction.

4. The developing unit according to claim 3, wherein an inclined surface is provided at a tip portion of the protruding portion that is positioned at a position closer to the tip of the protruding portion than the second region is, and the inclined surface is inclined in a direction away from an opening portion of the communication hole, which is open toward an inside of the hole portion, toward a tip thereof, and at least a part of the communication hole overlaps the inclined surface of the protruding portion as viewed in a direction orthogonal to the rotation axis direction.

5. The developing unit according to claim 4, wherein at least a part of a space between an outer peripheral surface of the tip portion and the inner peripheral surface of the hole portion is filled with the adhesive.

6. The developing unit according to claim 1, wherein the frame body and the end portion member are made of a styrene-based resin composition.

7. The developing unit according to claim 1, further comprising a plurality of gears configured to transmit a driving force to the developing roller, the plurality of gears being disposed between the bearing member and the end portion member, wherein the end portion member is a cover member configured to cover the plurality of gears.

8. The developing unit according to claim 7, wherein the plurality of gears include:

a developing gear provided at the end portion of the developing roller in the rotation axis direction; and a drive force receiving member including a driving force receiving portion configured to receive the driving force from an outside of the developing unit, and a gear portion configured to transmit the driving force toward the developing gear, and one and the other end portions of the drive force receiving member in the rotation axis direction are supported by the bearing member and the end portion member, respectively.

9. The developing unit according to claim 1, wherein the frame body and the end portion member includes the hole portion and the protruding portion, respectively, and wherein the bearing member includes a through hole that penetrates in the rotation axis direction at a position corresponding to the hole portion of the frame body, and a portion of the protruding portion that penetrates the through hole of the bearing member toward a side of the frame body is inserted into the hole portion.

* * * * *